US012264452B2

(12) United States Patent
Narikawa et al.

(10) Patent No.: US 12,264,452 B2
(45) Date of Patent: Apr. 1, 2025

(54) WORK MACHINE

(71) Applicant: HITACHI CONSTRUCTION MACHINERY CO., LTD., Tokyo (JP)

(72) Inventors: Ryu Narikawa, Tokyo (JP); Kouji Fujita, Ibaraki (JP); Hideaki Itou, Ibaraki (JP); Hidefumi Ishimoto, Ibaraki (JP); Teppei Saitoh, Tokyo (JP); Tadashi Nishizawa, Tokyo (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 236 days.

(21) Appl. No.: 18/023,465

(22) PCT Filed: Mar. 1, 2022

(86) PCT No.: PCT/JP2022/008656
§ 371 (c)(1),
(2) Date: Feb. 27, 2023

(87) PCT Pub. No.: WO2022/186215
PCT Pub. Date: Sep. 9, 2022

(65) Prior Publication Data

US 2023/0358014 A1 Nov. 9, 2023

(30) Foreign Application Priority Data

Mar. 2, 2021 (JP) ..... 2021-032298

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 9/123* (2013.01); *E02F 9/2033* (2013.01);
(Continued)

(58) Field of Classification Search
CPC ... E02F 3/32; E02F 3/435; E02F 9/123; E02F 9/2033; E02F 9/261
See application file for complete search history.

(56) References Cited

U.S. PATENT DOCUMENTS

2018/0305902 A1* 10/2018 Tsukamoto ..... E02F 3/439
2020/0199853 A1 6/2020 Konda et al.
(Continued)

FOREIGN PATENT DOCUMENTS

JP 2016089389 A 5/2016
JP 2019065661 A 4/2019
(Continued)

OTHER PUBLICATIONS

International Search Report of PCT/JP2022/008656 dated May 10, 2022.

*Primary Examiner* — Seth A Silverman
(74) *Attorney, Agent, or Firm* — MATTINGLY & MALUR, PC

(57) ABSTRACT

Provided is a work machine that allows assisting a loading work without giving uncomfortable feeling to an operator. The control device 40 of the work machine 1 includes an allowable range calculation section 46 that calculates an allowable range indicating a range in which the front work device 2 is movable in a height direction allowed in a swing operation; an operation determining section 45 that determines whether the work machine 1 is under a convey operation; and an operation control section 4 that controls a turn operation of a boom 8 such that the position of the front work device 2 in the height direction remains within the allowable range when the work machine 1 is determined to be under the convey operation.

6 Claims, 12 Drawing Sheets

(51) Int. Cl.

| | |
|---|---|
| ***E02F 9/12*** | (2006.01) |
| ***E02F 9/20*** | (2006.01) |
| ***E02F 9/26*** | (2006.01) |
| *E02F 9/22* | (2006.01) |

(52) U.S. Cl.
CPC ..... *E02F 9/261* (2013.01); *E02F 9/2228* (2013.01); *E02F 9/2285* (2013.01); *E02F 9/2292* (2013.01)

(56) References Cited

U.S. PATENT DOCUMENTS

| | | | | |
|---|---|---|---|---|
| 2021/0002851 | A1* | 1/2021 | Morita | E02F 3/439 |
| 2021/0002852 | A1* | 1/2021 | Nishi | E02F 9/2282 |
| 2021/0341033 | A1* | 11/2021 | Breutzman | G05G 5/02 |

FOREIGN PATENT DOCUMENTS

| | | | |
|---|---|---|---|
| JP | 2020169515 | A | 10/2020 |
| WO | 2019189013 | A1 | 10/2019 |

* cited by examiner

WORK MACHINE

TECHNICAL FIELD

The present invention relates to a work machine.

BACKGROUND ART

An articulated work machine (for example, a hydraulic excavator) including a front work device (for example, a boom, an arm, and an attachment including a bucket or the like) driven by a hydraulic actuator has been known. This type of work machine performs a loading work of a target object by performing a convey operation and a dump operation (for example, dirt dumping operation). The convey operation conveys the target object, such as excavated earth and sand, toward a loaded machine, such as a carrier machine (for example, a dump truck). The dump operation dumps the target object conveyed by the convey operation onto the loaded machine.

When the loading work is performed, if a position of the front work device (for example, a position of the bucket) is low with respect to the loaded machine, the front work device possibly interferences with the loaded machine under the convey operation. On the other hand, if the position of the front work device is excessively high with respect to the loaded machine, the dumped target object possibly damages the loaded machine. For example, a hydraulic excavator for mine might dump about 50 tons of earth and sand onto the dump truck at one time of the dirt dumping operation. If the position of the bucket is excessively high with respect to the dump truck, the dumped dirt possibly seriously damages the dump truck. An operator of the work machine who performs the loading work is required to perform a linked operation of the swing operation of the upper swing body and the turn operation of the front work device while confirming the position of the loaded machine, and thus a sophisticated skill is required.

A technique for assisting this type of loading work is disclosed in, for example, Patent Literature 1. Patent Literature 1 discloses a loading machine control device that includes an avoidable location identification section. The avoidable location identification section identifies an interference avoiding position having a height same as a dirt dumping position and a distance from the swing center of the upper swing body same as a distance from the swing center to the dirt dumping position. In the interference avoiding position, the loaded machine is not present under the bucket.

CITATION LIST

Patent Literature

Patent Literature 1: JP 2019-65661 A

SUMMARY OF INVENTION

Technical Problem

The loading machine control device of Patent Literature 1 automatically moves the bucket from an excavation complete position to the interference avoiding position upon input of an operation signal for instructing a dirt dumping from an operator. When the bucket reaches the interference avoiding position, the loading machine control device of Patent Literature 1 automatically moves the bucket to a dirt dumping position by halting an operation of the front work device and continuing the swing operation of the upper swing body alone. That is, since the loading machine control device of Patent Literature 1 moves the bucket along a trajectory passing through the interference avoiding position and the dirt dumping position, the operator possibly feels uncomfortable feeling depending on the trajectory.

The present invention has been made in consideration of the above-described points and an object of which is to provide a work machine that allows assisting a loading work without giving uncomfortable feeling to an operator.

Solution to Problem

In order to solve the above-described problems, a work machine according to the invention is provided. The work machine is for loading a target object onto a loaded machine by performing a convey operation and a dump operation, the convey operation conveying the target object toward the loaded machine, the dump operation dumping the target object conveyed by the convey operation onto the loaded machine. The work machine comprises: an upper swing body that swings with respect to a lower traveling body; a working device mounted on the upper swing body and including a boom, an arm, and a bucket; a posture detecting device that detects a turn angle of the working device and a swing angle of the upper swing body; an object detecting device that detects a position of the loaded machine; and a control device that controls operations of the working device and the upper swing body. The control device includes: an allowable range calculation section that calculates an allowable range indicating a range in which the working device is movable in a height direction allowed in the swing operation of the upper swing body based on a detection result of the object detecting device; an operation determining section that determines whether the work machine is under the convey operation or not based on a detection result of the posture detecting device and a detection result of the object detecting device; an operation control section that controls a turn operation of the boom such that the position of the working device in the height direction remains within the allowable range when the work machine is determined to be under the convey operation. The allowable range calculation section calculates a range of the turn angle of the boom defined by a lower limit value and an upper limit value as the allowable range, the lower limit value of the position in the height direction allowing the working device to avoid interference with the loaded machine under the convey operation, the upper limit value of the position in the height direction obtained based on at least one of a dimension of the bucket, a capacity of the bucket, a type of the target object, or a specific gravity of the target object.

Advantageous Effects of Invention

The present invention can provide a work machine that allows assisting a loading work without giving uncomfortable feeling to an operator.

The problems, configurations, and effects other than those described above will be made apparent from the following description of embodiments.

BRIEF DESCRIPTION OF DRAWINGS

FIG. 1*l* is a flowchart of a process relating to a loading assistance control executed by a control device of Embodiment 3.

DESCRIPTION OF EMBODIMENTS

Figure 1:
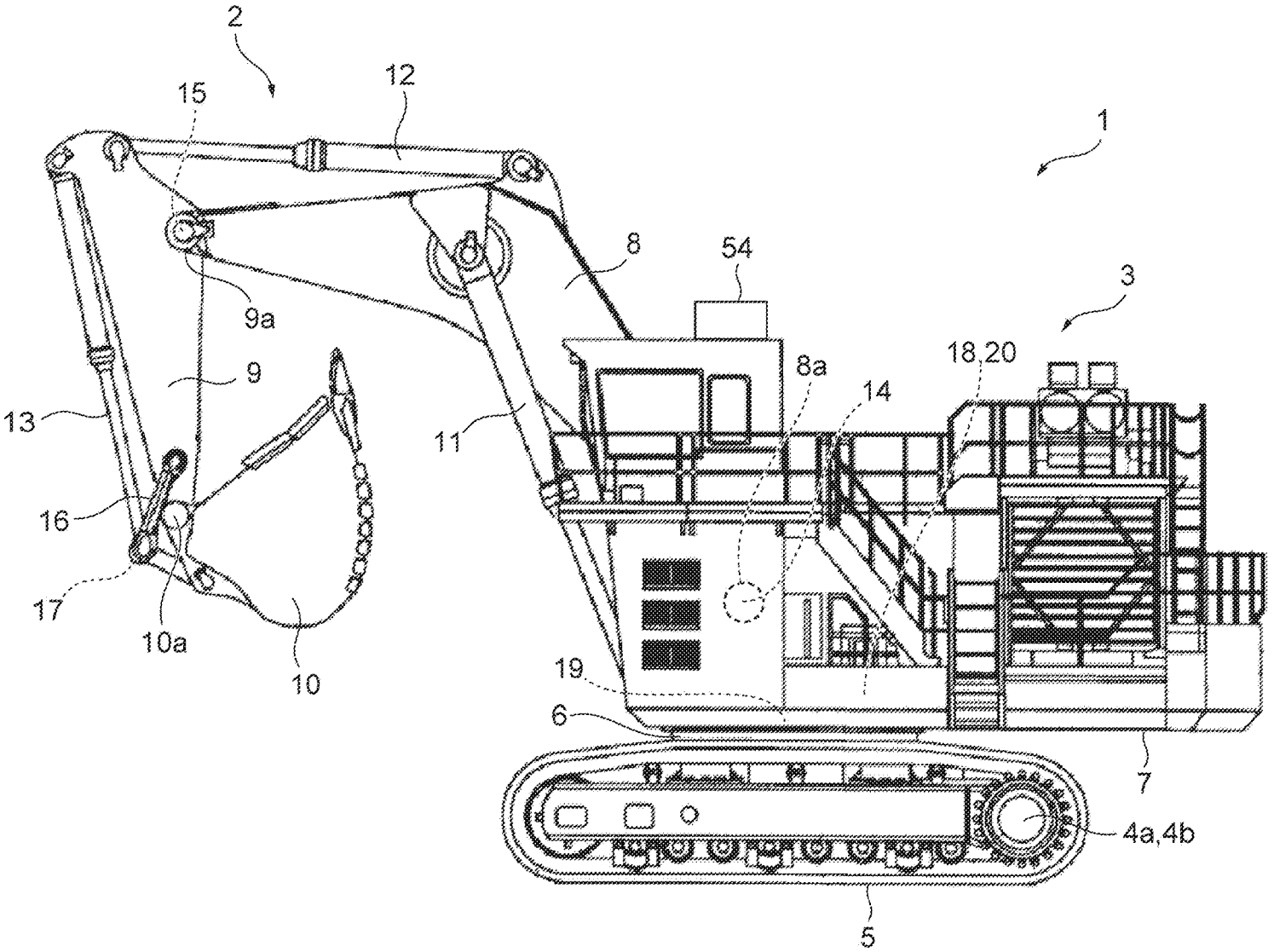
FIG. 1 is a diagram schematically illustrating a configuration of a work machine of Embodiment 1.

The following describes the embodiments of the present invention by referring to the drawings. It should be noted that configurations denoted by the same reference numerals in each embodiment have the same functions in each embodiment unless otherwise specified, and the description thereof will be omitted.

The work machine of the embodiment is a work machine that loads a target object onto a loaded machine by performing a convey operation that conveys the target object toward the loaded machine and a dump operation that dumps the target object conveyed by the convey operation onto the loaded machine. A following description will be given of a hydraulic excavator including a bucket as an example of the work machine. However, the work machine of the embodiment may be a hydraulic excavator including an attachment other than the bucket, and may be a work machine other than the hydraulic excavator that performs the loading work of the target object by performing the above-described convey operation and dump operation.

Embodiment 1

FIG. 1 is a diagram schematically illustrating a configuration of a work machine 1 of Embodiment 1.

The work machine 1 performs an excavation work that excavates a target excavation surface, such as the ground, and the loading work that loads the target object, such as excavated earth and sand, onto the loaded machine, such as a carrier machine or the like including a dump truck. In this loading work, the work machine 1 performs the above-described convey operation and dump operation. The work machine 1 includes an articulated front work device 2 and a machine main body 3 on which the front work device 2 is mounted. The front work device 2 holds the target object and turns in the vertical direction or the front-back direction. The front work device 2 is an example of "working device" recited in claims.

The machine main body 3 includes a lower traveling body 5 and an upper swing body 7. The lower traveling body 5 travels with a right traveling hydraulic motor 4*a* and a left traveling hydraulic motor 4*b* provided on a right side portion and a left side portion of the lower traveling body 5. The upper swing body 7 is mounted via a swing device above the lower traveling body 5 and swings using a hydraulic swing motor 6 of the swing device. In this embodiment, the right traveling hydraulic motor 4*a* and the left traveling hydraulic motor 4*b* are collectively referred to as "traveling hydraulic motors 4*a*, 4*b*."

The front work device 2 is an articulated working device configured with a plurality of front attachment members mounted in a front portion of the upper swing body 7. The upper swing body 7 swings with the front work device 2 mounted. The front work device 2 includes a boom 8, an arm 9, and a bucket 10. The boom 8 is coupled to a front portion of the upper swing body 7 turnably in the vertical direction. The arm 9 is coupled to a distal end portion of the boom 8 turnably in the vertical direction. The bucket 10 is coupled to a distal end portion of the arm 9 turnably in the vertical direction.

The boom 8 is coupled to the upper swing body 7 by a boom pin 8*a* and turns by expansion and contraction of a boom cylinder 11. The arm 9 is coupled to a distal end portion of the boom 8 by an arm pin 9*a* and turns by expansion and contraction of an arm cylinder 12. The bucket 10 is coupled to a distal end portion of the arm 9 by a bucket pin 10*a* and a bucket link 16 and turns by expansion and contraction of a bucket cylinder 13.

The boom pin 8*a* is provided with a boom angular sensor 14 that detects a turn angle of the boom 8. The arm pin 9*a* is provided with an arm angular sensor 15 that detects a turn angle of the arm 9. The bucket link 16 is provided with a bucket angular sensor 17 that detects a turn angle of the bucket 10.

The respective turn angles of the boom 8, the arm 9, and the bucket 10 may be obtained by detecting respective angles of the boom 8, the arm 9, and the bucket 10 with respect to the reference surface, such as the horizontal surface, by an inertial measurement device, and converting them into the respective turn angles. The respective turn angles of the boom 8, the arm 9, and the bucket 10 may be obtained by detecting respective strokes of the boom cylinder 11, the arm cylinder 12, and the bucket cylinder 13 by stroke sensors, and converting them into the respective turn angles.

The upper swing body 7 is provided with an inclined angle sensor 18 that detects an inclined angle of the machine main body 3 with respect to the reference surface, such as the horizontal surface. The swing device between the lower traveling body 5 and the upper swing body 7 is provided with a swing angle sensor 19 that detects a swing angle as a relative angle of the upper swing body 7 with respect to the lower traveling body 5. The upper swing body 7 is provided with an angular velocity sensor 20 that detects an angular velocity of the upper swing body 7. In this embodiment, the boom angular sensor 14, the arm angular sensor 15, the bucket angular sensor 17, the inclined angle sensor 18, and the swing angle sensor 19 are collectively referred to as "posture detecting device 53." The posture detecting device 53 detects the respective turn angles of the front work device 2, the swing angle of the upper swing body 7, and the like.

An operating device, which operates a plurality of hydraulic actuators 4*a*, 4*b*, 6, 11, 12, 13, is installed in an operator's cabin disposed in the upper swing body 7. Specifically, the operating device includes a right travel lever 23*a* for operating the right traveling hydraulic motor 4*a*, a left travel lever 23*b* for operating the left traveling hydraulic motor 4*b*, a right operation lever 22*a* for operating the boom cylinder 11 and the bucket cylinder 13, a left operation lever 22*b* for operating the arm cylinder 12 and the hydraulic swing motor 6. In this embodiment, the right travel lever 23*a*, the left travel lever 23*b*, the right operation lever 22*a*, and the left operation lever 22*b* are collectively referred to as "operation levers 22, 23." The operation levers 22, 23 are electrical levers.

The upper swing body 7 is provided with an object detecting device 54 that detects a type and a position of an object present around the work machine 1. The object detecting device 54 may be, for example, a Light Detection And Ranging (LiDAR), and may be a stereo camera. The object detecting device 54 can detect a position of the loaded machine for which the work machine 1 performs the loading work. A plurality of the object detecting devices 54 may be provided to the work machine 1.

Figure 2:
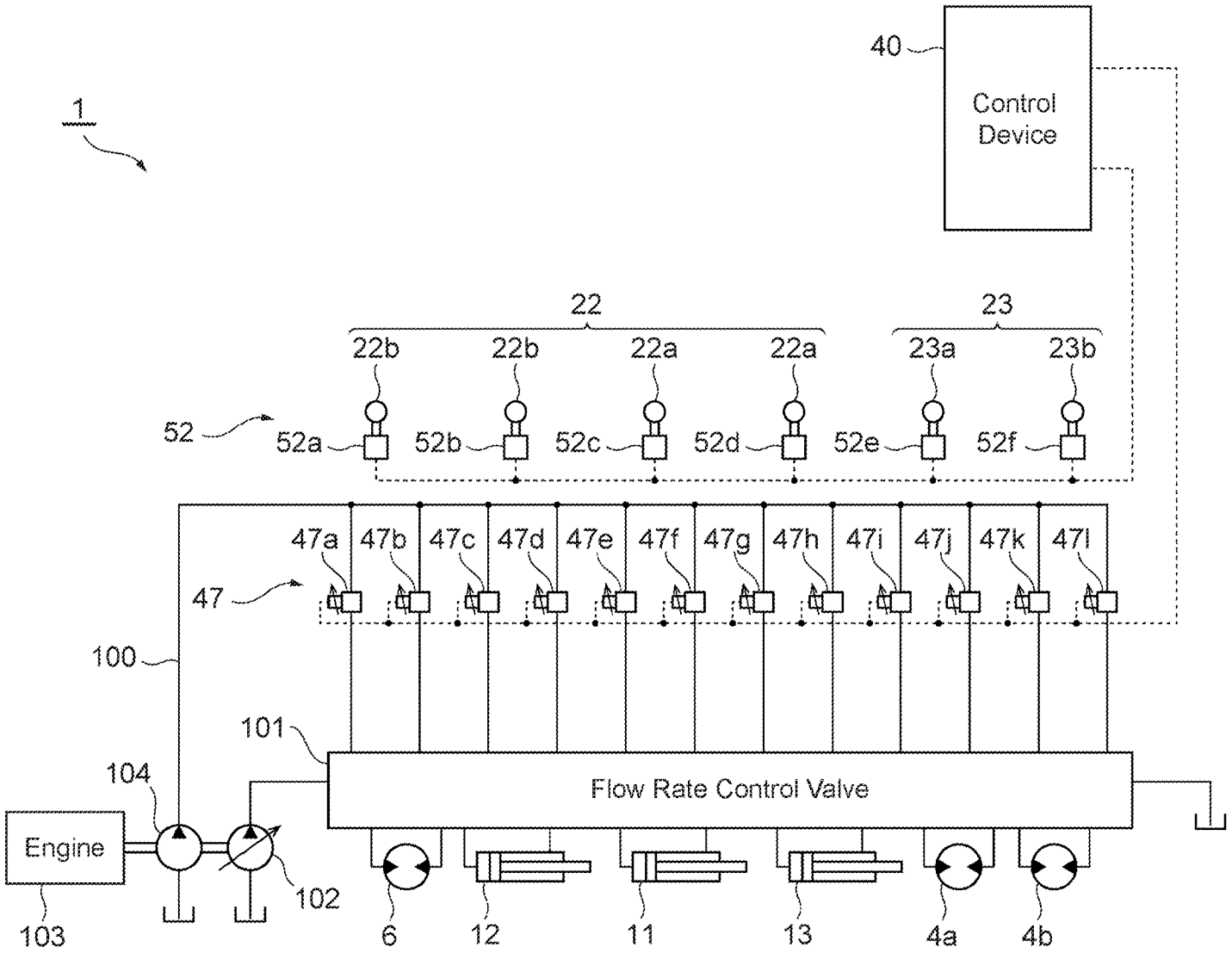
FIG. 2 is a diagram schematically illustrating a configuration of a hydraulic system mounted on the work machine shown in FIG. 1.

FIG. 2 is a diagram schematically illustrating a configuration of a hydraulic system mounted on the work machine 1 shown in FIG. 1.

An engine 103 as a prime mover mounted on the upper swing body 7 drives a hydraulic pressure pump 102 and a pilot pump 104. The control device 40 controls the turn operation of the front work device 2, the traveling operation of the lower traveling body 5, and the swing operation of the upper swing body 7 in response to operation information (operation amount and operation direction) of the operation levers 22, 23 by the operator. Specifically, the control device 40 detects the operation information (operation amount and operation direction) of the operation levers 22, 23 by the operator using sensors 52*a* to 52*f*, such as a rotary encoder and a potentiometer, and outputs control commands to electromagnetic proportional valves 47*a* to 47*l* corresponding to the detected operation information. The electromagnetic proportional valves 47*a* to 47*l* are disposed on a pilot line 100 and operates when the control commands are input from the control device 40, and the electromagnetic proportional valves 47*a* to 47*l* outputs pilot pressures to a flow rate control valve 101 for operating the flow rate control valve 101. In this embodiment, the operation information of the operation levers 22, 23 by the operator is also referred to as "operation instruction of operator." In this embodiment, the sensors 52*a* to 52*f* that detect this operation information are collectively referred to as "operation detecting device 52."

The flow rate control valve 101 controls a pressure oil to each of the hydraulic swing motor 6, the arm cylinder 12, the boom cylinder 11, the bucket cylinder 13, the right traveling hydraulic motor 4*a*, and the left traveling hydraulic motor 4*b* supplied from the hydraulic pressure pump 102 corresponding to the pilot pressures from the electromagnetic proportional valves 47*a* to 47*l*. The electromagnetic proportional valves 47*a*, 47*b* output the pilot pressures to the flow rate control valve 101 for controlling the pressure oil supplied to the hydraulic swing motor 6. The electromagnetic proportional valves 47*c*, 47*d* output the pilot pressures to the flow rate control valve 101 for controlling the pressure oil supplied to the arm cylinder 12. The electromagnetic proportional valves 47*e*, 47*f* output the pilot pressures to the flow rate control valve 101 for controlling the pressure oil supplied to the boom cylinder 11. The electromagnetic proportional valves 47*g*, 47*h* output the pilot pressures to the flow rate control valve 101 for controlling the pressure oil supplied to the bucket cylinder 13. The electromagnetic proportional valves 47*i*, 47*j* output the pilot pressures to the flow rate control valve 101 for controlling the pressure oil supplied to the right traveling hydraulic motor 4*a*. The electromagnetic proportional valves 47*k*, 47*l* output the pilot pressures to the flow rate control valve 101 for controlling the pressure oil supplied to the left traveling hydraulic motor 4*b*.

The boom cylinder 11, the arm cylinder 12, and the bucket cylinder 13 expand and contract with the supplied pressure oils to respectively turn the boom 8, the arm 9, and the bucket 10. This changes a position and a posture of the bucket 10. The hydraulic swing motor 6 rotates with the supplied pressure oil to swing the upper swing body 7. The right traveling hydraulic motor 4*a* and the left traveling hydraulic motor 4*b* rotate with the supplied pressure oil for causing the lower traveling body 5 to travel. In this embodiment, the traveling hydraulic motors 4*a*, 4*b*, the hydraulic swing motor 6, the boom cylinder 11, the arm cylinder 12, and the bucket cylinder 13 are collectively referred to as "hydraulic actuator."

Figure 3:
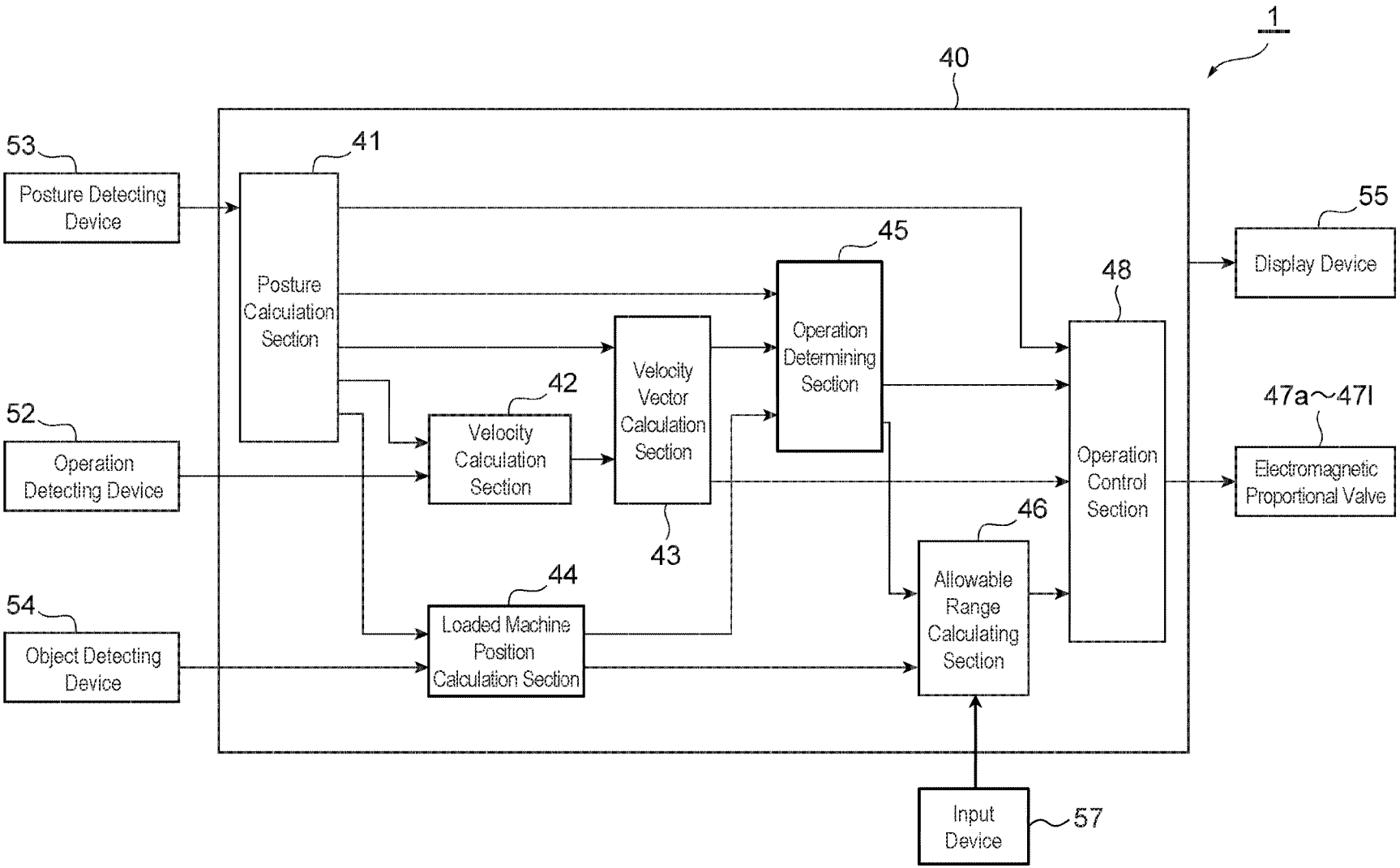
FIG. 3 is a diagram illustrating a functional configuration of a control device shown in FIG. 2.
Figure 4:
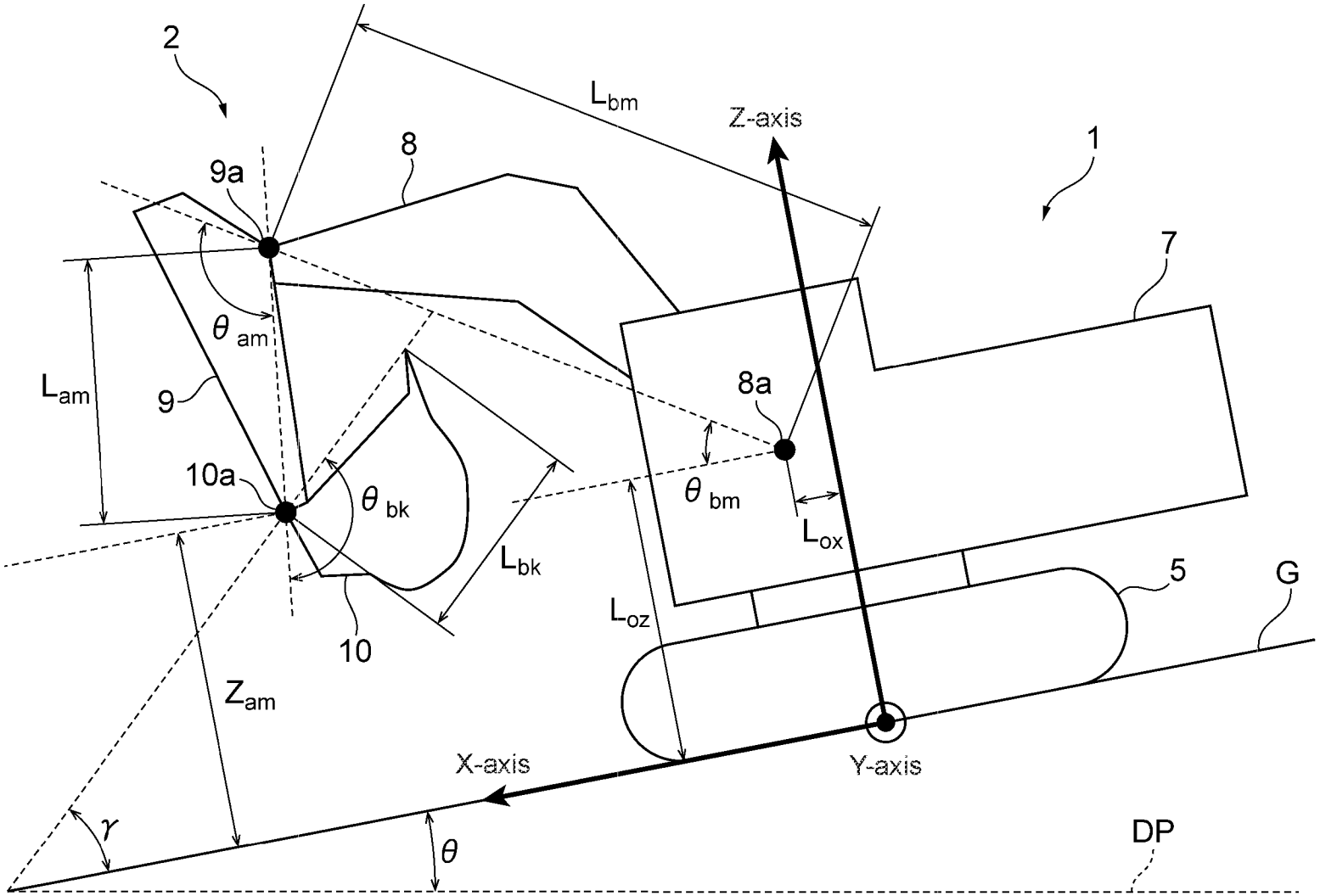
FIG. 4 is a diagram illustrating a reference coordinate system defined in the control device shown in FIG. 3.
Figure 5:
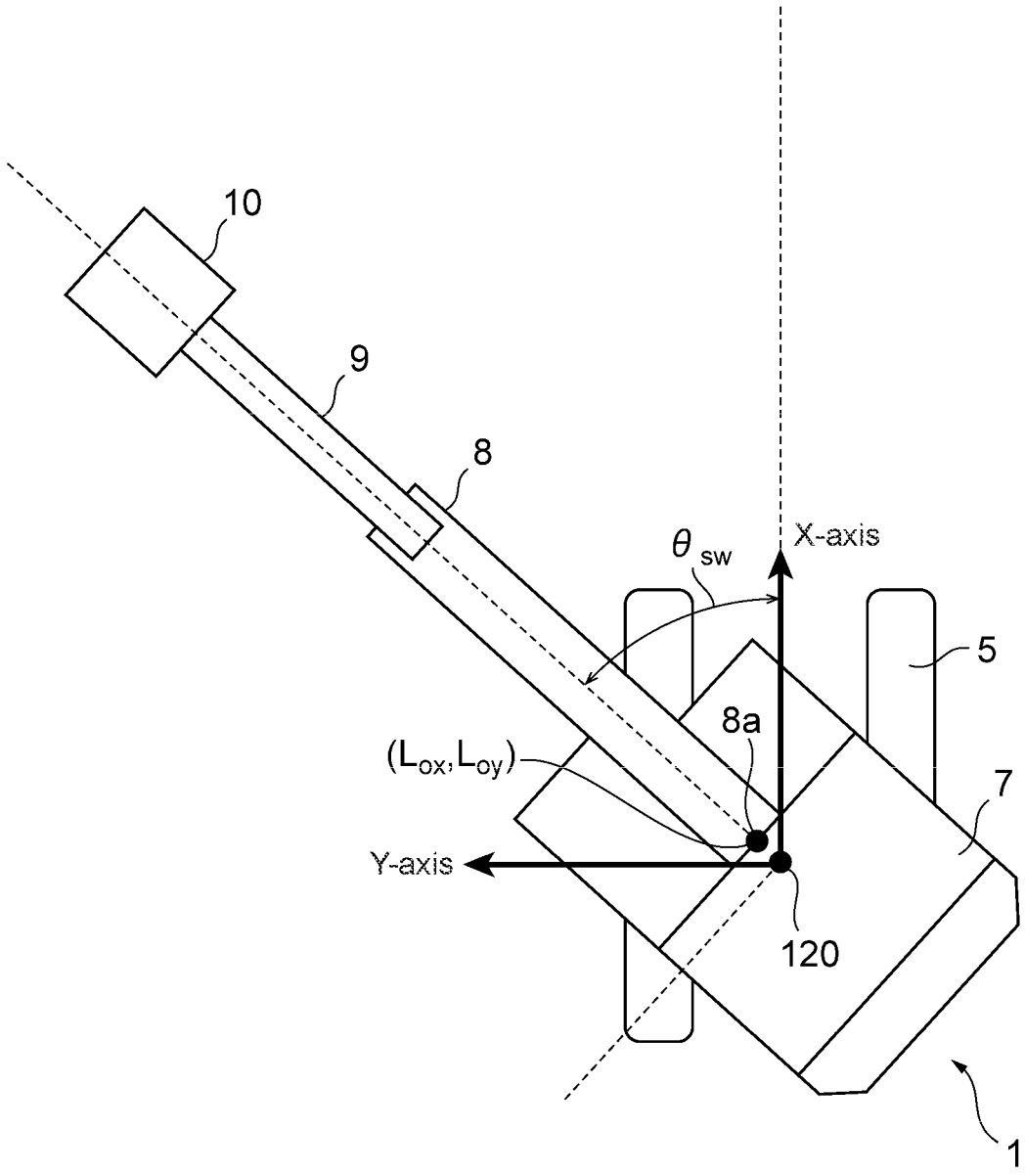
FIG. 5 is a view of the reference coordinate system shown in FIG. 4 viewed in another direction.
Figure 6:
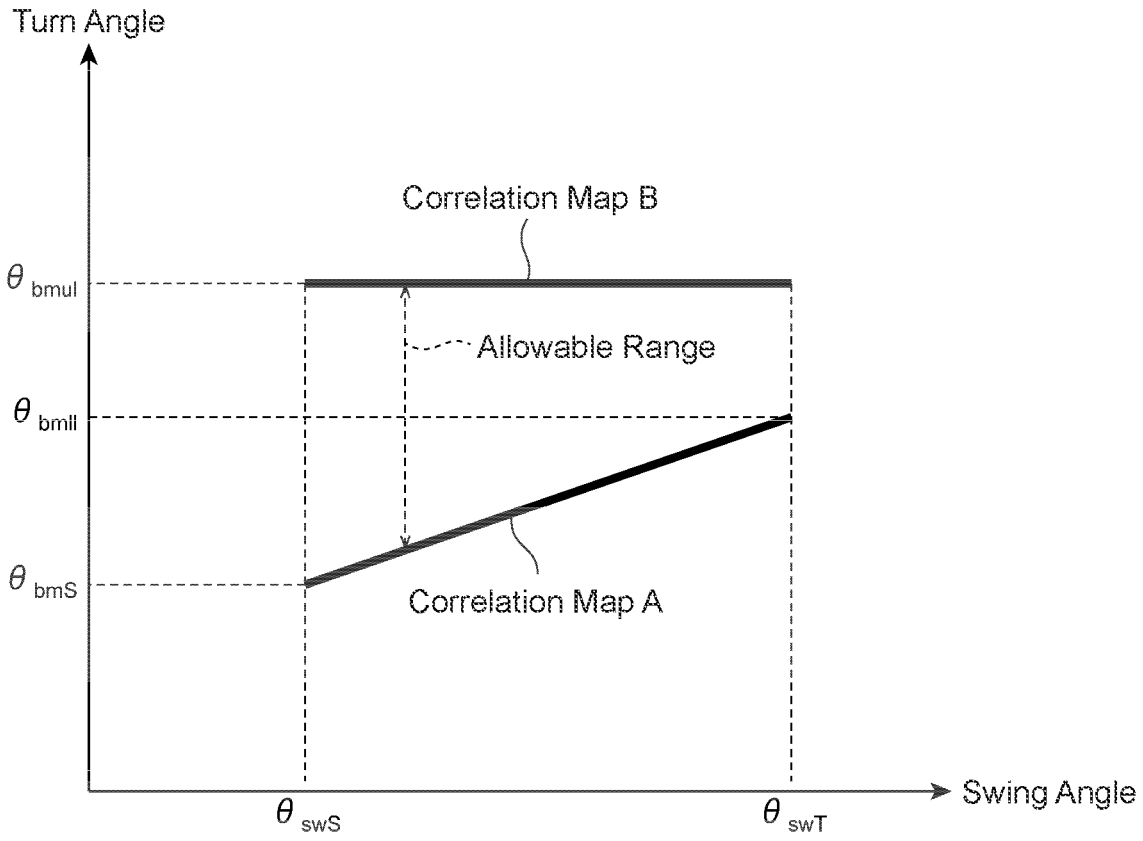
FIG. 6 is a diagram describing an allowable range calculated by an allowable range calculation section shown in FIG. 3.

FIG. 3 is a diagram illustrating a functional configuration of the control device 40 shown in FIG. 2. FIG. 4 is a diagram illustrating a reference coordinate system defined in the control device 40 shown in FIG. 3. FIG. 5 is a view of the reference coordinate system shown in FIG. 4 viewed in another direction. FIG. 6 is a diagram describing an allowable range calculated by an allowable range calculation section 46 shown in FIG. 3.

The control device 40 includes a posture calculation section 41, a velocity calculation section 42, a velocity vector calculation section 43, a loaded machine position calculation section 44, an operation determining section 45, an allowable range calculation section 46, and an operation control section 48.

The control device 40 has a preliminarily set reference coordinate system for identifying positions and postures of configuration elements of the work machine 1. The reference coordinate system of the embodiment is defined as a right hand coordinate system having the point as the origin at which the lower traveling body 5 contacts the ground G in a swing center 120 as shown in FIG. 4 and FIG. 5. The reference coordinate system is defined to have the forward direction of the lower traveling body 5 as the positive direction of the X-axis. The reference coordinate system of the embodiment is defined to have the direction of the swing center 120 extending upward as the positive direction of the Z-axis. The reference coordinate system of the embodiment is defined to be orthogonal to each of the X-axis and the Z-axis and have the left side as the positive direction of the Y-axis. In the reference coordinate system of the embodiment, the XY plane is fixed to the ground G.

In the reference coordinate system of the embodiment, a swing angle of the upper swing body 7 is defined to have a state in which the front work device 2 is parallel to the X-axis as 0 degree. In a state where the upper swing body 7 has the swing angle of 0 degree, the operation plane of the front work device 2 is parallel to the XZ plane, a direction of raising operation of the boom 8 is the positive direction of the Z-axis, the dumping direction of the arm 9 and the bucket 10 is the positive direction of the X-axis.

The posture calculation section 41 calculates the postures and the like of the configuration elements of the work machine 1 in the reference coordinate system from detection signals of the posture detecting device 53. Specifically, the posture calculation section 41 calculates a turn angle $\theta_{bm}$ of the boom 8 with respect to the X-axis from a detection signal of a turn angle of the boom 8 output from the boom angular sensor 14. The posture calculation section 41 calculates a turn angle $\theta_{am}$ of the arm 9 with respect to the boom 8 from a detection signal of a turn angle of the arm 9 output from the arm angular sensor 15. The posture calculation section 41 calculates a turn angle $\theta_{bk}$ of the bucket 10 with respect to the arm 9 from a detection signal of a turn angle of the bucket 10 output from the bucket angular sensor 17. The posture calculation section 41 calculates a swing angle $\theta_{sw}$ of the upper swing body 7 with respect to the X-axis (the lower traveling body 5) from a detection signal of a swing angle of the upper swing body 7 output from the swing angle sensor 19.

Furthermore, the posture calculation section 41 calculates the respective positions of the boom 8, the arm 9, and the bucket 10 based on the calculated respective turn angles $\theta_{bm}$, $\theta_{am}$, $\theta_{bk}$ of the front work device 2 and swing angle $\theta_{sw}$ of the upper swing body 7, a dimension $L_{bm}$ of the boom 8, a dimension $L_{am}$ of the arm 9, and a dimension $L_{bk}$ of the bucket 10. The dimension $L_{bm}$ of the boom 8 is a length from the boom pin 8*a* to the arm pin 9*a*. The dimension $L_{am}$ of the arm 9 is a length from the arm pin 9*a* to the bucket pin 10*a*. The dimension $L_{bk}$ of the bucket 10 is a length from the bucket pin 10*a* to a distal end portion (for example, a distal end portion of tooth) of the bucket 10.

Furthermore, the posture calculation section 41 calculates the inclined angle $\theta$ of the machine main body 3 (the lower traveling body 5) with respect to a reference plane DP from a detection signal of the inclined angle of the machine main body 3 output from the inclined angle sensor 18. The reference plane DP is, for example, a horizontal plane orthogonal to the gravity direction. The inclined angle $\theta$ includes a pitch angle as a rotation angle around the Y-axis and a roll angle as a rotation angle around the X-axis. The posture calculation section 41 calculates a ground angle $\gamma$ as an angle of the bucket 10 with respect to the ground G from the respective turn angles $\theta_{bm}$, $\theta_{am}$, $\theta_{bk}$ of the front work device 2. The ground angle $\gamma$ of the bucket 10 is an angle formed between the ground G and a straight line passing through the distal end portion of the bucket 10 and the bucket pin 10*a*.

The velocity calculation section 42 calculates respective speeds of hydraulic actuators 6, 11, 12, 13 from a detection signal of the operation detecting device 52. Specifically, the control device 40 stores a table showing a correspondence relation between operation amounts of the operation levers 22, 23 and the respective speeds of the hydraulic actuators 6, 11, 12, 13 in advance. By referring to this table, the velocity calculation section 42 calculates the respective speeds of the hydraulic actuators 6, 11, 12, 13 from the operation amounts included in the operation information of the operation levers 22, 23 output from the operation detecting device 52. The velocity calculation section 42 can convert a velocity of the hydraulic swing motor 6 into the swing speed of the upper swing body 7. The velocity calculation section 42 can convert a velocity of the boom cylinder 11 into a turn speed of the boom 8. The velocity calculation section 42 can convert a velocity of the arm cylinder 12 into a turn speed of the arm 9. The velocity calculation section 42 can convert a velocity of the bucket cylinder 13 into a turn speed of the bucket 10.

The velocity calculation section 42 may calculate the respective turn speeds of the front work device 2 by calculating temporal changes of the respective turn angles $\theta_{bm}$, $\theta_{am}$, $\theta_{bk}$ of the front work device 2 calculated by the posture calculation section 41. The velocity calculation section 42 may calculate a swing speed of the upper swing body 7 by calculating a temporal change of a swing angle $\theta_{sw}$ of the upper swing body 7 calculated by the posture calculation section 41.

The velocity vector calculation section 43 calculates speed vectors occurring in the front work device 2 based on a calculation result of the posture calculation section 41 and a calculation result of the velocity calculation section 42. Specifically, the velocity vector calculation section 43 calculates a speed vector occurring at a distal end of the arm 9 based on the respective turn angles $\theta_{bm}$, $\theta_{am}$, $\theta_{bk}$ of the front work device 2, the swing angle $\theta_{sw}$ of the upper swing body 7, the respective turn speeds of the front work device 2, and the swing speed of the upper swing body 7.

The loaded machine position calculation section 44 calculates a position of the loaded machine in the reference coordinate system from a position of the loaded machine detected by the object detecting device 54. The object detecting device 54 is mounted on the upper swing body 7. Accordingly, the loaded machine position calculation section 44 can calculate a position of the loaded machine in the reference coordinate system based on the swing angle $\theta_{sw}$ of the upper swing body 7 and an installation position of the object detecting device 54 with respect to the reference coordinate system.

The operation determining section 45 determines whether the work machine 1 is under the convey operation or not based on a detection result of the object detecting device 54 and a detection result of the posture detecting device 53. Specifically, the operation determining section 45 obtains the ground angle $\gamma$ of the bucket 10 calculated by the posture calculation section 41 based on the detection result of the posture detecting device 53, a direction of the speed vector calculated by the velocity vector calculation section 43 based on the detection result of the posture detecting device 53, and the position of the loaded machine calculated by the loaded machine position calculation section 44 based on the detection result of the object detecting device 54. The operation determining section 45 determines that the work machine 1 is under the convey operation when the ground angle $\gamma$ of the bucket 10 is equal to or more than a predetermined value, the direction of the speed vector occurring at the distal end of the arm 9 is a direction toward the loaded machine, and the front work device 2 has not reached the position of the loaded machine yet. The operation determining section 45 determines that the work machine 1 is not under the convey operation when the ground angle $\gamma$ of the bucket 10 is less than the predetermined value, the direction of the speed vector occurring at the distal end of the arm 9 is not a direction toward the loaded machine, or the front work device 2 has reached the position of the loaded machine.

The allowable range calculation section 46 calculates an allowable range showing a range in which the front work device 2 is movable in the height direction while the upper swing body 7 is under the swing operation based on the detection result of the object detecting device 54. In detail, the allowable range calculation section 46 calculates a range of the turn angle of the boom 8 as the allowable range. The range of the turn angle of the boom 8 is defined by a lower limit value and an upper limit value. The lower limit value of the position of the front work device 2 in the height direction allows the front work device 2 to avoid interference with the loaded machine under the convey operation. The upper limit value of the position of the front work device 2 in the height direction allows avoiding a damage on the loaded machine due to the target object in the dump operation. In this embodiment, the allowable range calculation section 46 sets the turn angle $\theta_{bm}$ of the boom 8 corresponding to the lower limit value of the position of the front work device 2 in the height direction that allows the front work device 2 to avoid interference with the loaded machine under the convey operation, to the lower limit value of the allowable range. In this embodiment, the allowable range calculation section 46 sets the turn angle $\theta_{bm}$ of the boom 8 corresponding to the upper limit value of the position of the front work device 2 in the height direction that allows avoiding a damage on the loaded machine due to the target object in the dump operation, to the upper limit value of the allowable range.

In this embodiment, a relation between the lower limit value of the allowable range for the position of the front work device 2 in the height direction and a swing angle $\theta_{sw}$ of the front work device 2 to reach the position of the loaded machine is also referred to as "correlation map A." In this embodiment, a relation between the upper limit value of the allowable range for the position of the front work device 2 in the height direction and the swing angle $\theta_{sw}$ is also referred to as "correlation map B." In this embodiment, a relation between the turn angle $\theta_{bm}$ of the boom 8 corresponding to the lower limit value of the allowable range and the swing angle $\theta_{sw}$ is assumed to be "correlation map A." In this embodiment, a relation between the turn angle $\theta_{bm}$ of the boom 8 corresponding to the upper limit value of the allowable range and the swing angle $\theta_{sw}$ is assumed to be "correlation map B."

A following description will be given of a specific calculation method for calculating the allowable range by the allowable range calculation section 46. In the following description, a dimension of the work machine 1 in the width direction is assumed to be negligible. First, a height $Z_{am}$ of the distal end portion of the arm 9 from the ground G in the reference coordinate system is given using a height $L_{oz}$ of the boom pin 8*a* from the ground G in the reference coordinate system with the following formula.

[Math. 1]

$$Z_{am}=L_{oz}-L_{bm}\sin\theta_{bm}-L_{am}\sin(\theta_{bm}+\theta_{am}) \quad (1)$$

Considering a dimension $L_{bk}$ of the bucket 10 and a margin, and assuming that a height (the lower limit value of the position of the front work device 2 in the height direction) in the reference coordinate system is $Z_{ll}$ where the distal end portion of the arm 9 should reach without interference with the loaded machine when the front work device 2 reaches the loaded machine, the lower limit value $\theta_{bmll}$ of the turn angle $\theta_{bm}$ of the boom 8 in this case is given with the following formula.

[Math. 2]

$$\theta_{bmll}=\sin^{-1}\left(\frac{-Z_{ll}}{\sqrt{a_{ll}^2+b_{ll}^2}}\right)-\alpha_{bmll} \quad (2)$$

In Formula (2), $a_{ll}$, $b_{ll}$, $\alpha_{bmll}$ are coefficients for composition of trigonometric functions.

Similarly, assuming that an allowable height of the distal end portion of the arm 9 from the ground G (the upper limit value of the position of the front work device 2 in the height direction) for the target object not to damage the loaded machine is $Z_{ul}$, the upper limit value $\theta_{bmul}$ of the turn angle $\theta_{bm}$ of the boom 8 in this case is given with the following formula. In this embodiment, the upper limit value $\theta_{bmul}$ of the turn angle $\theta_{bm}$ may be a predetermined constant value.

[Math. 3]

$$\theta_{bmul}=\sin^{-1}\left(\frac{-Z_{ul}}{\sqrt{a_{ul}^2+b_{ul}^2}}\right)-\alpha_{bmul} \quad (3)$$

In Formula (3), $a_{ul}$, $b_{ul}$, $\alpha_{bmul}$ are coefficients for composition of trigonometric functions.

The height $Z_{ul}$ can be preliminarily set based on at least one of the dimension $L_{bk}$ and a capacity of the bucket 10, a type of the earth and sand to be excavated, or a specific gravity (weight) of the earth and sand to be excavated, or a combination thereof. Especially, the height $Z_{ul}$ can be preliminarily set with a relation (combination) between the dimension $L_{bk}$ and the capacity of the bucket 10 and the type and specific gravity (weight) of the earth and sand to be excavated. For example, the height $Z_{ul}$ may be a constant value obtained by adding four times of the dimension $L_{bk}$ of the bucket 10 to the height of the distal end portion of the arm 9 from the ground G. For example, the height $Z_{ul}$ can be set to be lower assuming that the larger the gross weight of the target object is loaded onto the loaded machine in one time of the loading work, the more seriously the loaded machine is damaged in the dump operation. Specifically, for example, the height $Z_{ul}$ can be set adjustably considering the damage using the value obtained by adding the four times of the dimension Lot of the bucket 10 to the height of the distal end portion of the arm 9 from the ground G as a reference Z of the height $Z_{ul}$. For example, the height $Z_{ul}$ may be set to be lower as the capacity of the bucket 10 increases, and the height $Z_{ul}$ may be set to be lower as the specific gravity (weight) of the target object such as the earth and sand to be excavated increases. For example, the height $Z_{ul}$ may be set to be lower as an average size (for example, an average particle size of the earth and sand) and/or a size variation of the target object increases. The setting contents of the heights $Z_{ul}$ in consideration thereof can be summarized as shown in Table 1. Table 1 summarizes the relation (combination) between the capacities of the buckets 10, the types of the target objects, the specific gravities of the target objects, and the heights $Z_{ul}$. In the embodiment, the work machine 1 includes an input device 57 for an operator to input information on the capacity of the bucket 10, and the type and the specific gravity of the target object. The allowable range calculation section 46 of the control device 40 is configured to perform setting and adjusting of the height $Z_{ul}$ based on the information input by the input device 57. The work machine 1 may include a receiving device that receives information on the capacity of the bucket 10, and the type and the specific gravity of the target object from outside (for example, a control system). The allowable range calculation section 46 of the control device 40 may be configured to perform setting and adjusting of the height $Z_{ul}$ based on the information received by the receiving device. The work machine 1 may include an imaging device that captures the target object. The work machine 1 may include a retrieving device that retrieves map information, the position information of the work machine 1, geological information (for example, information on geological layer components) of a work site associated with the map information. The allowable range calculation section 46 of the control device 40 may be configured to determine the type and the specific gravity of the target object based on an image of the target object captured by the imaging device or information retrieved by the retrieving device, and perform setting and adjusting of the height $Z_{ul}$ based on them. The work machine 1 does not have to perform setting and adjusting of the height $Z_{ul}$ based on the capacity of the bucket 10 or the information on the type and the specific gravity of the target object, and may perform setting and adjusting of the height $Z_{ul}$ by directly inputting the height $Z_{ul}$ to the input device 57 by an operator.

TABLE 1

| Bucket Capacity | Type of Target Object | Specific Gravity of Target Object | Gross Weight per Loading | Damage on Loaded Machine | Height $Z_{ul}$ (Upper Limit Value) |
|---|---|---|---|---|---|
| Medium | Sand and Sandy Soil Type | Medium | Medium | Medium | Z |
| | Cohesive Soil Type | Small | Small | Small | 1.1 Z |
| | Ore Type | Large | Large | Large | 0.9 Z |
| Large | Sand and Sandy Soil Type | Medium | Large | Large | 0.9 Z |
| | Cohesive Soil Type | Small | Medium | Medium | Z |
| | Ore Type | Large | Extra Large | Extra Large | 0.8 Z |

A position $X_{am}$ in a X-axis direction of the distal end portion of the arm 9 in the reference coordinate system is given using a position $L_{ox}$ in the X-axis direction and a position $L_{oy}$ in a Y-axis direction of the boom 8*a* with respect to the origin in the reference coordinate system with the following formula.

[Math. 4]

$$X_{am}=(L_{ox}+L_{bm}\cos\theta_{bm}+L_{am}\cos(\theta_{bm}+\theta_{am})\cos\theta_{sw}-L_{oy}\sin\theta_{sw} \quad (4)$$

A swing angle $\theta_{swT}$ at which the front work device 2 reaches the loaded machine is given using a position $X_t$ in the X-axis direction of the loaded machine in the reference coordinate system with the following formula.

[Math. 5]

$$\theta_{swT}=\cos^{-1}\left(\frac{-X_t}{\sqrt{a_{swT}^2+b_{swT}^2}}\right)+\alpha_{swT} \quad (5)$$

In Formula(S), $a_{swT}$, $b_{swT}$, $\alpha_{swT}$ are coefficients for composition of trigonometric functions.

Assuming that the turn angle of the boom 8 is $\theta_{bmS}$ and the swing angle of the upper swing body 7 is $\theta_{swS}$ when it is determined to be under the convey operation by the operation determining section 45, correlation maps A and B as shown in FIG. 6 are obtained. In the convey operation, when the turn angle $\theta_{bm}$ of the boom 8 and/or the turn angle $\theta_{am}$ of the arm 9 change, the height $Z_{ll}$ where the distal end portion of the arm 9 should reach when the front work device 2 reaches the loaded machine, the lower limit value $\theta_{bmll}$ of the turn angle $\theta_{bm}$ of the boom 8 at this time, and the swing angle $\theta_{swT}$ required to reach the position $X_t$ of the loaded machine also change. Accordingly, the allowable range calculation section 46 sequentially updates the correlation map A shown in FIG. 6.

That is, the correlation map A calculated by the allowable range calculation section 46 indicates how the turn angle $\theta_{bm}$ corresponding to the lower limit value of the allowable range changes in response to the change of the swing angle $\theta_{sw}$. In this embodiment, the turn angle $\theta_{bm}$ corresponding to the lower limit value of the allowable range monotonically increases in response to the increases of the swing angle $\theta_{sw}$ as shown in FIG. 6. Similarly, the correlation map B indicates how the turn angle $\theta_{bm}$ corresponding to the upper limit value of the allowable range changes in response to the change of the swing angle $\theta_{sw}$. In this embodiment, the turn angle $\theta_{bm}$ (that is, $\theta_{bmul}$) corresponding to the upper limit value of the allowable range is a predetermined constant value as shown in FIG. 6, for the increase of the swing angle $\theta_{sw}$.

When it is determined to be under the convey operation by the operation determining section 45, the operation control section 48 controls the turn speed of the front work device 2 such that the position of the front work device 2 in the height direction remains within the allowable range, thus controlling the turn operation of the front work device 2. Specifically, when the position of the front work device 2 in the height direction that moves in accordance with an operation instruction by an operator on the front work device 2 falls below the lower limit value or exceeds the upper limit value of the allowable range (which is predicted), the operation control section 48 invalidates the operation instruction. Then, the operation control section 48 controls the turn speed of the front work device 2 such that the position of the front work device 2 in the height direction remains within the allowable range. In this embodiment, when it is determined to be under the convey operation by the operation determining section 45, the operation control section 48 controls the turn speed of the boom 8 such that the position of the front work device 2 in the height direction remains within the allowable range. Specifically, the operation control section 48 calculates the turn speed (a target turn speed) of the boom 8 such that the turn angle $\theta_{bm}$ of the boom 8 remains within the allowable range between the correlation map A and the correlation map B shown in FIG. 6.

For example, in the work machine 1, the operator does not perform a raising operation of the boom 8 or an amount of the raising operation of the boom 8 is insufficient, and the turn angle $\theta_{bm}$ of the boom 8 is predicted to fall below the correlation map A in some cases. In this case, the operation control section 48 invalidates the operation instruction by the operator that causes the turn angle $\theta_{bm}$ to fall below the correlation map A, and calculates the target turn speed of the boom 8 for automatically performing the raising operation such that the turn angle $\theta_{bm}$ of the boom 8 exceeds the correlation map A. Furthermore, for example, in the work machine 1, the amount of the raising operation of the boom 8 by the operator is excessive or the like, and the turn angle $\theta_{bm}$ of the boom 8 is predicted to exceed the correlation map B in some cases. In this case, the operation control section 48 invalidates the operation instruction of the operator that causes the turn angle $\theta_{bm}$ to exceed the correlation map B, and calculates the target turn speed of the boom 8 for automatically performing a lowering operation such that the turn angle $\theta_{bm}$ of the boom 8 falls below the correlation map B. Furthermore, for example, in the work machine 1, the raising operation of the arm 9 by the operator is performed or the like, and the turn angle $\theta_{bm}$ of the boom 8 is predicted to exceed the correlation map B in some cases. In this case, the operation control section 48 invalidates the operation instruction of the operator that causes the turn angle $\theta_{bm}$ to exceed the correlation map B, and calculates the target turn speed of the boom 8 for automatically performing a lowering operation of the boom 8 such that the turn angle $\theta_{bm}$ of the boom 8 falls below the correlation map B.

Then, the operation control section 48 calculates a target speed of the boom cylinder 11 corresponding to the target turn speed of the boom 8. Then, the operation control section 48 outputs a control command to the electromagnetic proportional valves 47*a* to 47*l* (specifically, the electromagnetic proportional valves 47*e*, 47*f*) for operating the boom cylinder 11 corresponding to the target speed of the boom cylinder 11. The electromagnetic proportional valves 47*a* to 47*l* (specifically, the electromagnetic proportional valves 47*e*, 47*f*) generate the pilot pressures for controlling the pressure oil supplied to the boom cylinder 11 and output them to the flow rate control valve 101, thus operating the boom cylinder 11 corresponding to the target speed. The boom 8 turns corresponding to the target turn speed, and the turn angle $\theta_{bm}$ of the boom 8 remains within the allowable range.

The operation control section 48 predicts that the turn angle $\theta_{bm}$ of the boom 8 operated by the operator remains within the allowable range between the correlation maps A and B in some cases. In this case, the operation control section 48 controls the turn operation of the boom 8 in accordance with the operation instruction of the operator so as to cause the boom 8 to turn.

The control device 40 generates information indicating execution of a control intervention when the control intervention is executed to invalidate the operation instruction of the operator and assists the loading work in a case of, for example, automatically performing the raising operation or the lowering operation of the boom 8. Then, the control device 40 can notify the operator of the information indicating execution of the control intervention by displaying the information on a display device 55 or emitting a voice from a speaker. In this embodiment, invalidating the operation instruction of the operator and executing of the control intervention for assisting the loading work is also referred to as "loading assistance control."

Figure 7:
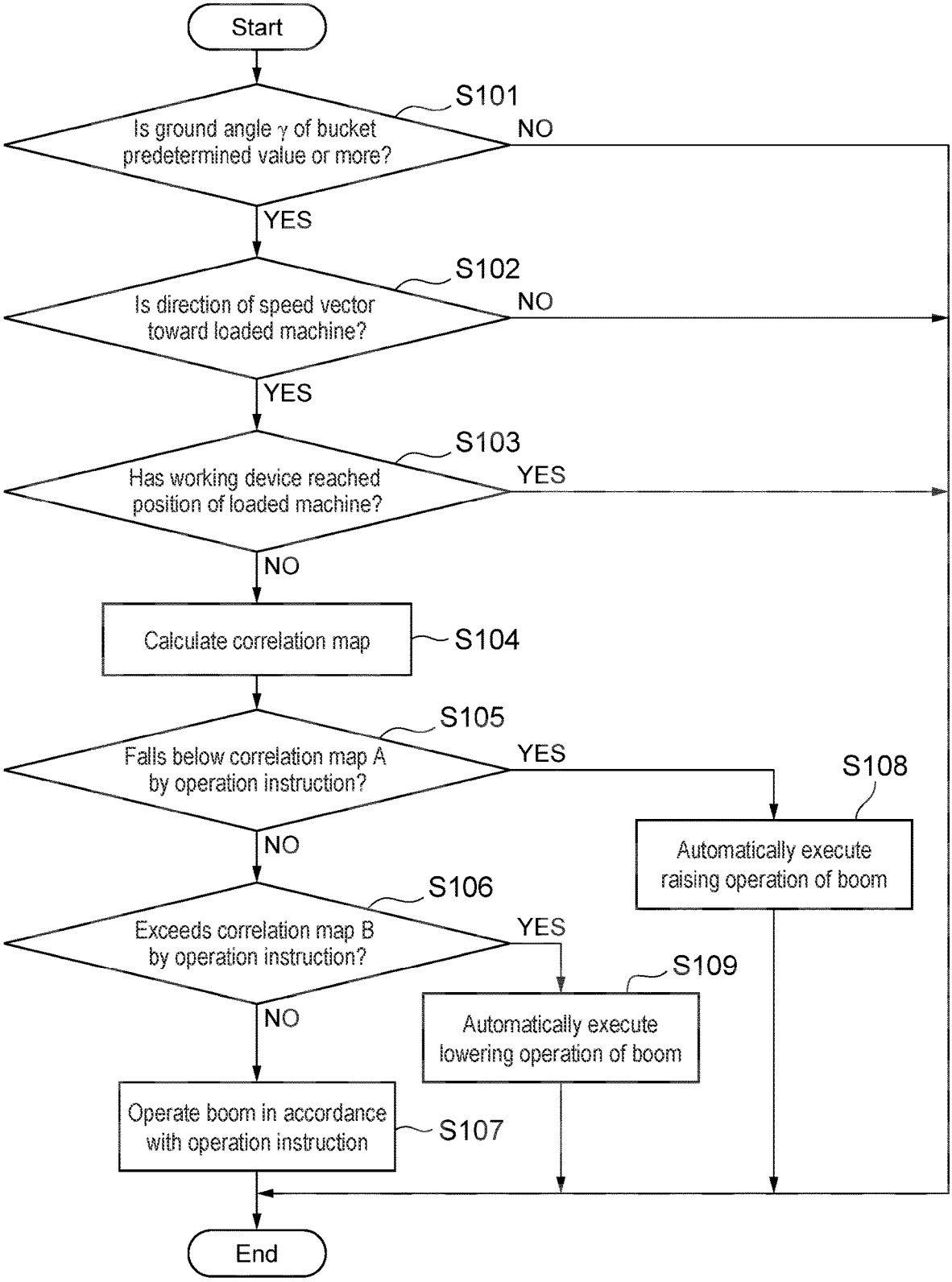
FIG. 7 is a flowchart of a process relating to a loading assistance control executed by the control device shown in FIG. 3.

FIG. 7 is a flowchart of a process relating to a loading assistance control executed by the control device 40 shown in FIG. 3.

In Step S101, the control device 40 determines whether the ground angle $\gamma$ of the bucket 10 is equal to or more than a predetermined value or not. The predetermined value is a lower limit value of the ground angle $\gamma$ of the bucket 10 when the bucket 10 holds the target object. When the ground angle $\gamma$ of the bucket 10 is equal to or more than the predetermined value, the bucket 10 may be holding the target object, and the work machine 1 may be under the convey operation. When the ground angle $\gamma$ of the bucket 10 is equal to or more than the predetermined value, the control device 40 determines that the work machine 1 may be under the convey operation and advances the process to Step S102. On the other hand, when the ground angle $\gamma$ of the bucket 10 is less than the predetermined value, the control device 40 determines that the work machine 1 is not under the convey operation and terminates the process.

In Step S102, the control device 40 determines whether a direction of the speed vector occurring at the distal end of the arm 9 is a direction toward the loaded machine or not. When the direction of the speed vector occurring at the distal end of the arm 9 is the direction toward the loaded machine, the front work device 2 may be moving toward the loaded machine, and the work machine 1 may be under the convey operation. When the direction of the speed vector occurring at the distal end of the arm 9 is the direction toward the loaded machine, the control device 40 determines that the work machine 1 may be under the convey operation and advances the process to Step S103. On the other hand, when the direction of the speed vector occurring at the distal end of the arm 9 is not the direction toward the loaded machine, the control device 40 determines that the work machine 1 is not under the convey operation and terminates the process.

In Step S103, the control device 40 determines whether the front work device 2 has reached the position of the loaded machine or not. When the front work device 2 has reached the position of the loaded machine, the convey operation may have been terminated. When the front work device 2 has not reached the position of the loaded machine, the control device 40 determines that the work machine 1 may be under the convey operation and advances the process to Step S104. On the other hand, when the front work device 2 has reached the position of the loaded machine, the control device 40 determines that the work machine 1 is not under the convey operation and terminates the process.

In Step S104, the control device 40 calculates the correlation maps A and B. That is, the control device 40 calculates the lower limit value and the upper limit value in the allowable range of the turn angle $\theta_{bm}$ of the boom 8.

In Step S105, the control device 40 determines whether the turn angle $\theta_{bm}$ of the boom 8 falls below the correlation map A by the operation of the operator or not. The control device 40 advances the process to Step S108 when the turn angle $\theta_{bm}$ falls below the correlation map A. On the other hand, the control device 40 advances the process to Step S106 when the turn angle $\theta_{bm}$ does not fall below the correlation map A.

In Step S106, the control device 40 determines whether the turn angle $\theta_{bm}$ of the boom 8 exceeds the correlation map B by the operation of the operator or not. The control device 40 advances the process to Step S109 when the turn angle $\theta_{bm}$ exceeds the correlation map B. On the other hand, the control device 40 advances the process to Step S107 when the turn angle $\theta_{bm}$ does not exceed the correlation map B.

In Step S107, the control device 40 controls the turn operation of the boom 8 in accordance with the operation instruction of the operator so as to cause the boom 8 to turn. Then, the control device 40 terminates the process.

In Step S108, the control device 40 invalidates the operation instruction of the operator that causes the turn angle $\theta_{bm}$ to fall below the correlation map A. Then, the control device 40 automatically executes the raising operation of the boom 8 such that the turn angle $\theta_{bm}$ of the boom 8 exceeds the correlation map A. Then, the control device 40 terminates the process.

In Step S109, the control device 40 invalidates the operation instruction of the operator that causes the turn angle $\theta_{bm}$ to exceed the correlation map B. Then, the control device 40 automatically executes the lowering operation of the boom 8 such that the turn angle $\theta_{bm}$ of the boom 8 falls below the correlation map B. Then, the control device 40 terminates the process. When the turn angle $\theta_{bm}$ of the boom 8 does not exceed the correlation map B in Step S109, the control device 40 does not have to automatically execute the lowering operation of the boom 8 and may automatically halt the turn operation of the boom 8.

Thus, the control device 40 of Embodiment 1 includes an allowable range calculation section 46 that calculates the allowable range indicating a range of the position of the front work device 2 in the height direction allowed in the swing operation of the upper swing body 7, based on the detection result of the object detecting device 54. The control device 40 includes an operation determining section 45 that determines whether it is under the convey operation or not based on the detection result of the posture detecting device 53 and the detection result of the object detecting device 54. The control device 40 includes an operation control section 48 that controls the turn operation of the boom 8 such that the position of the front work device 2 in the height direction remains within the allowable range when it is determined to be under the convey operation. The allowable range calculation section 46 calculates the range of the turn angle of the boom 8 defined by the lower limit value and the upper limit value as the allowable range. The lower limit value of the position of the front work device 2 in the height direction allows the front work device 2 to avoid interference with the loaded machine under the convey operation. The upper limit value of the position of the front work device 2 in the height direction is obtained based on the capacity of the bucket 10 and the type or the specific gravity of the target object.

As a result, the work machine 1 of Embodiment 1 does not move the front work device 2 along only a specific trajectory and can move the front work device 2 along various trajectories on which intention of the operator is reflected as far as the position of the front work device 2 in the height direction remains within the allowable range. Furthermore, the allowable range is the range of the position of the front work device 2 in the height direction for avoiding the interference of the front work device 2 with the loaded machine and for avoiding the damage on the loaded machine by the target object. Accordingly, the work machine 1 of Embodiment 1 can assist the loading work without giving uncomfortable feeling to the operator while suppressing the interference with the loaded machine and the damage on the loaded machine.

Especially, the operation control section 48 of Embodiment 1 invalidates the operation instruction of the operator when the position of the front work device 2 in the height direction that moves in accordance with the operation instruction of the operator falls below the lower limit value or exceeds the upper limit value. Then, the operation control section 48 controls the turn speed of the boom 8 such that the position of the front work device 2 in the height direction remains within the allowable range.

As a result, the work machine 1 of Embodiment 1 ensures keeping the position of the front work device 2 in the height direction within the allowable range by the control intervention even when the position of the front work device 2 in the height direction is about to deviate from the allowable range by operation of the operator. Accordingly, the work machine 1 of Embodiment 1 ensures suppressing the interference with the loaded machine and the damage on the loaded machine, and can actively assist the loading work without giving uncomfortable feeling to the operator.

Figure 8:
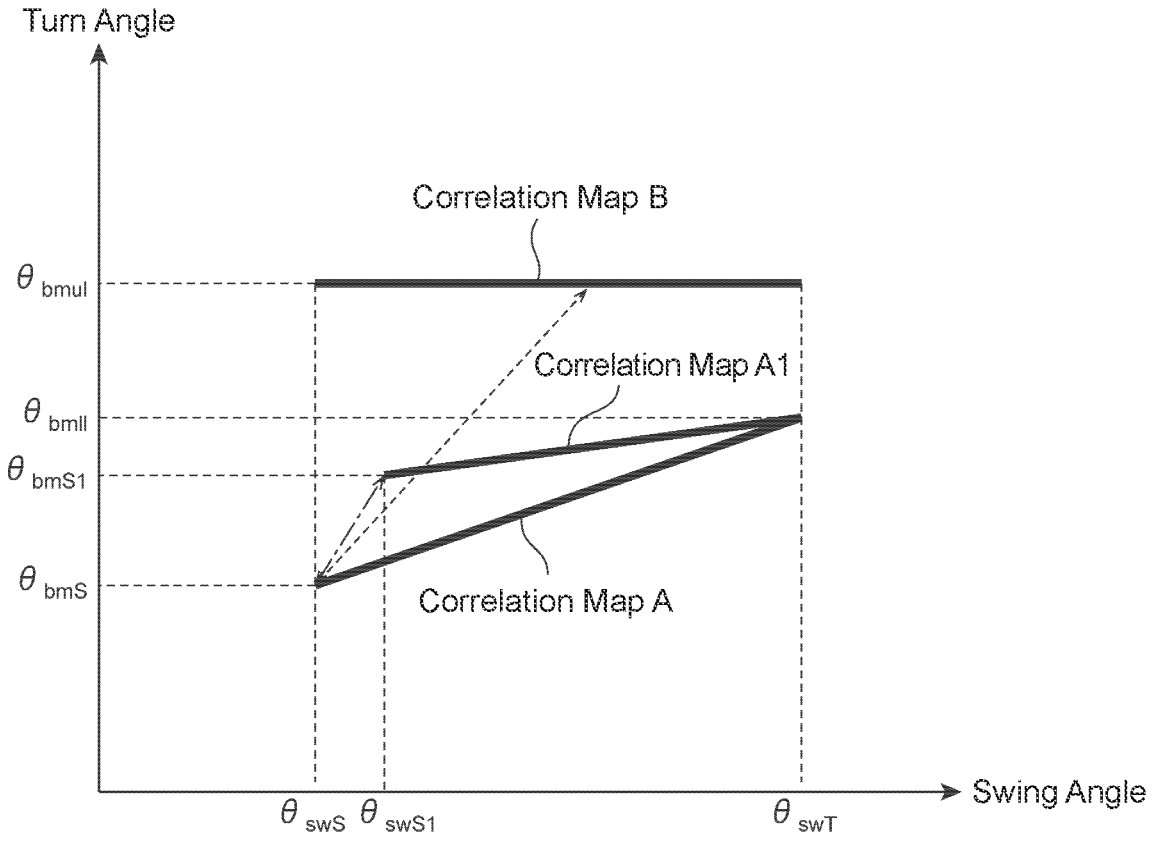
FIG. 8 is a diagram illustrating an update example of a correlation map shown in FIG. 6.

FIG. 8 is a diagram illustrating an update example a correlation map A shown in FIG. 6.

In the work machine 1, while the front work device 2 moves within the allowable range in accordance with the operation instruction of the operator, the operator halts the operation or the like, and the operation instruction becomes undetectable by the operation detecting device 52 in some cases. In this case, the allowable range calculation section 46 updates the allowable range by setting the position of the front work device 2 in the height direction when the operation instruction becomes undetectable, as a new lower limit value.

In the example of FIG. 8, after the calculation of the allowable range by the allowable range calculation section 46, the boom 8 moves remaining within the allowable range in the swing operation in accordance with the operation instruction of the operator, and a condition that an increasing rate of the turn angle $\theta_{bm}$ with respect to the swing angle $\theta_{sw}$ is greater than the correlation map A is assumed. In this condition, the arrow of the dash-dot-dash line in FIG. 8 indicates that the operator halted the raising operation of the boom 8 at the swing angle $\theta_{swS1}$. This is a case where the operation instruction becomes undetectable by the operation detecting device 52 while the boom 8 turns within the allowable range in accordance with the operation instruction of the operator. In this case, the allowable range calculation section 46 newly calculates a correlation map Al using the turn angle $\theta_{bmS1}$ corresponding to the swing angle $\theta_{swS1}$ when the operation instruction becomes undetectable. That is, the allowable range calculation section 46 updates the allowable range by setting the position of the front work device 2 in the height direction when the operation instruction becomes undetectable, as a new lower limit value. FIG. 8 illustrates the turn angle $\theta_{bmS1}$ as the turn angle $\theta_{bm}$ corresponding to the updated lower limit value of the allowable range.

As a result, the work machine 1 of Embodiment 1 ensures keeping the position of the front work device 2 in the height direction within the allowable range with the intention of the operator reflected as much as possible even when the position of the front work device 2 in the height direction is about to fall below the lower limit value of the allowable range, by the operation of the operator. Accordingly, the work machine 1 of Embodiment 1 can assist the loading work without giving the uncomfortable feeling to the operator as less as possible while surely suppressing the interference with the loaded machine and the damage on the loaded machine.

The arrow of the dashed line in FIG. 8 indicates that the operator continued the raising operation of the boom 8 in the above-described condition, and the turn angle $\theta_{bm}$ is about to exceed the correlation map B. In this case, the operation control section 48 invalidates the operation instruction of the operator that causes the turn angle $\theta_{bm}$ to exceed the correlation map B. Then, the operation control section 48 controls the turn speed of the boom 8 such that the turn angle $\theta_{bm}$ does not exceed the correlation map B by automatically executing the lowering operation of the boom 8 and/or automatically halting the turn operation of the boom 8.

As a result, the work machine 1 of Embodiment 1 ensures keeping the position of the front work device 2 in the height direction within the allowable range with the intention of the operator reflected as much as possible even when the position of the front work device 2 in the height direction is about to exceed the upper limit value of the allowable range, by the operation of the operator. Accordingly, the work machine 1 of Embodiment 1 can assist the loading work without giving the uncomfortable feeling to the operator as less as possible while surely suppressing the interference with the loaded machine and the damage on the loaded machine.

Embodiment 2

A description will be given of a work machine 1 of Embodiment 2 using FIG. 9 and FIG. 10. In the work machine 1 of Embodiment 2, explanations for configurations and operations similar to those of Embodiment 1 will be omitted FIG. 9 is a diagram illustrating a functional configuration of a work machine 1 of Embodiment 2.

The work machine 1 of Embodiment 2 includes a target object information acquisition device 56 that obtains information on the target object held onto the front work device 2, that is, the target object held onto the bucket 10. The target object information acquisition device 56 is configured of a weight detecting device that detects, for example, a weight of the bucket 10 or a weight of the target object held onto the bucket 10. The operation determining section 45 of Embodiment 2 performs the determination by adding an obtained result of the target object information acquisition device 56 to the determination condition of Embodiment 1 as the determination condition for performing the determination of whether the work machine 1 is under the convey operation or not.

Figure 9:
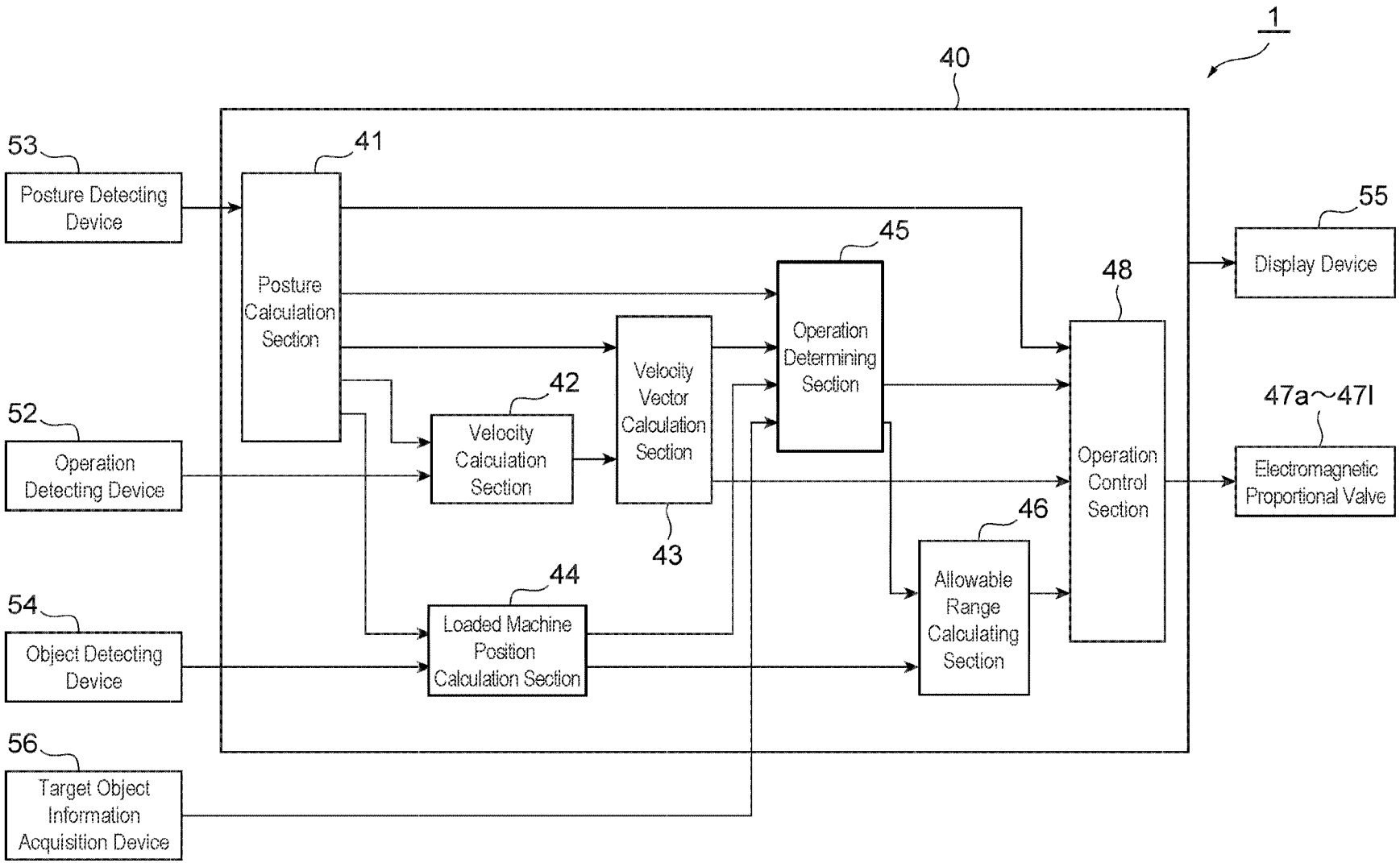
FIG. 9 is a diagram illustrating a functional configuration of a work machine of Embodiment 2.
Figure 10:
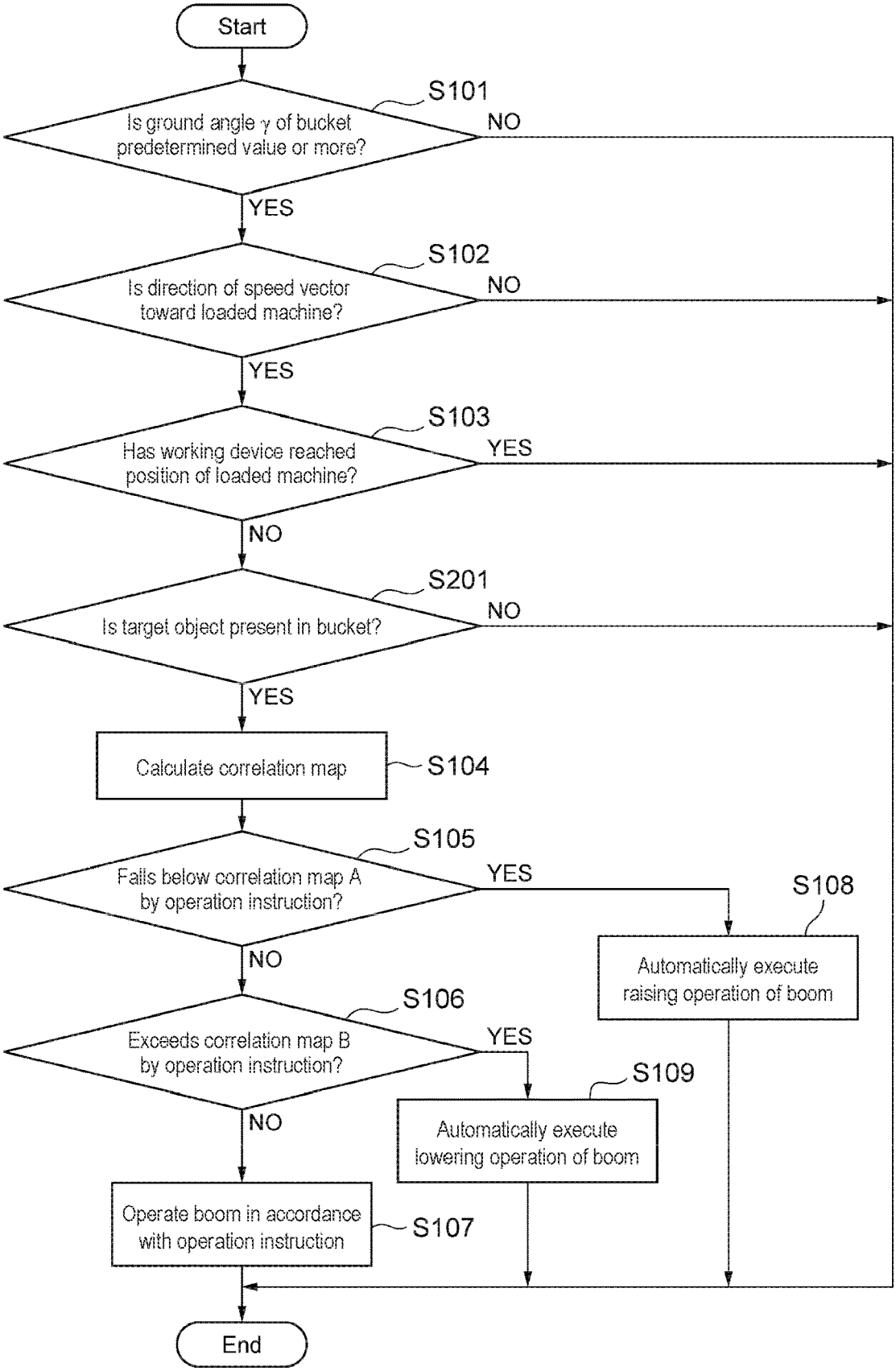
FIG. 10 is a flowchart of a process relating to a loading assistance control executed by a control device shown in FIG. 9.

FIG. 10 is a flowchart of a process relating to a loading assistance control executed by the control device 40 shown in FIG. 9.

In Step S101 to Step S103 shown in FIG. 10, the control device 40 executes processes similar to the processes in Step S101 to Step S103 of Embodiment 1 shown in FIG. 7. However, when the front work device 2 has not reached the position of the loaded machine in Step S103, the control device 40 determines that the work machine 1 may be under the convey operation and advances the process to Step S201.

In Step S201, the control device 40 determines whether a sufficient amount of the target object for operation of the convey operation is present in the bucket 10 or not based on the obtained result of the target object information acquisition device 56. For example, the control device 40 determines whether the weight of the bucket 10 obtained by the target object information acquisition device 56 is greater than a weight (hereinafter referred to as "predetermined weight") in which the sufficient amount of the target object is not present in the bucket 10. The control device 40 determines that the sufficient amount of the target object is present in the bucket 10 when the weight of the bucket 10 obtained by the target object information acquisition device 56 is greater than the predetermined weight. In this case, the control device 40 determines that the work machine 1 may be under the convey operation and advances the process to Step S104. On the other hand, the control device 40 determines that the sufficient amount of the target object is not present in the bucket 10 when the weight of the bucket 10 obtained by the target object information acquisition device 56 is equal to or less than the predetermined weight. In this case, the control device 40 determines that the work machine 1 is not under the convey operation and terminates the process.

In Step S104 to Step S109 shown in FIG. 10, the control device 40 executes processes similar to the processes in Step S104 to Step S109 of Embodiment 1 shown in FIG. 7.

Step S201 only has to be performed before Step S104, and does not have to be performed between Step S103 and Step S104. Step S201 may be performed before, for example, Step S101.

Thus, the operation determining section 45 of Embodiment 2 determines whether the bucket 10 holds the target object or not based on the obtained result of the target object information acquisition device 56, and determines whether it is under the convey operation or not based on the determination result.

As a result, the operation determining section 45 of Embodiment 2 can determine that the work machine 1 is under the convey operation, more accurately than Embodiment 1. Accordingly, the work machine 1 of Embodiment 2 can more accurately obtain the intention of the operator who performs operation relating to the convey operation than Embodiment 1, and thus can assist the loading work without giving the uncomfortable feeling to the operator compared with Embodiment 1.

Embodiment 3

A description will be given of a work machine 1 of Embodiment 3 using FIG. 11. In the work machine 1 of Embodiment 3, explanations for configurations and operations similar to those of Embodiment 1 or Embodiment 2 will be omitted.

Figure 11:
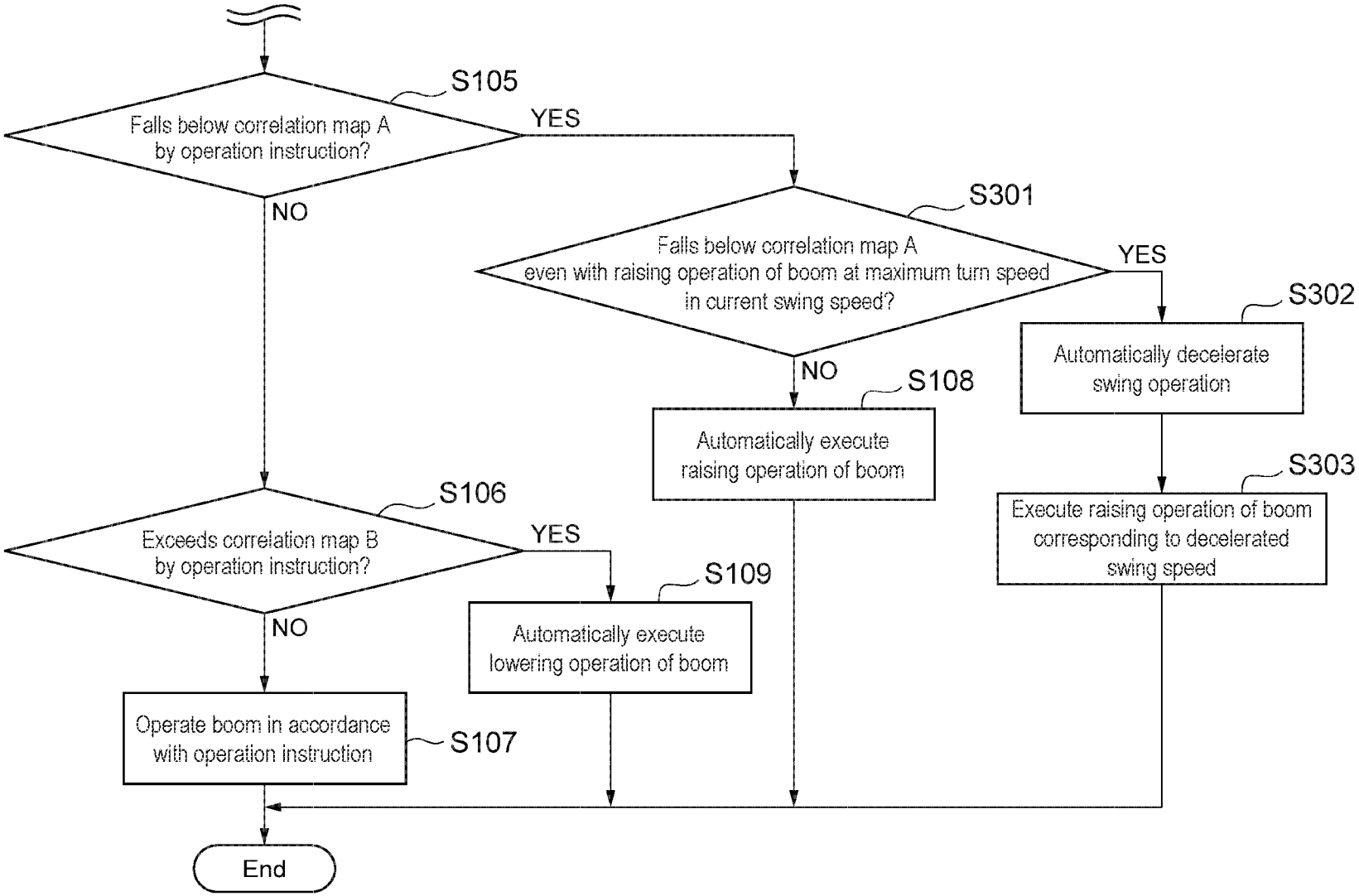

FIG. 11 is a flowchart of a process relating to a loading assistance control executed by a control device 40 of Embodiment 3. In FIG. 11, Step S101 to Step S104 performed before Step S105 are similar to those of Embodiment 1 or Embodiment 2, their illustrations will be omitted.

In order for the turn angle $\theta_{bm}$ of the boom 8 to exceed the correlation map A shown in FIG. 6 in the swing operation, it is necessary to increase the turn angle $\theta_{bm}$ of the boom 8 corresponding to the increase of the swing angle $\theta_{sw}$. In this respect, when the increase of the swing angle $\theta_{sw}$ is excessive, the turn angle $\theta_{bm}$ of the boom 8 does not follow in some cases. That is, the swing speed of the upper swing body 7 is excessively fast, the turn speed of the raising operation of the boom 8 does not catch up in some cases.

As a countermeasure against this, the control device 40 of Embodiment 3 adds Step S301 to Step S303 to Step S101 to Step S109 of Embodiment 1 shown in FIG. 7, and executes the process relating to the loading assistance control.

In Step S105 shown in FIG. 11, the control device 40 advances the process to Step S301 when the turn angle $\theta_{bm}$ falls below the correlation map A. On the other hand, the control device 40 advances the process to Step S106 when the turn angle $\theta_{bm}$ does not fall below the correlation map A.

In Step S301, the control device 40 determines whether the turn angle $\theta_{bm}$ falls below the correlation map A or not even when the raising operation of the boom 8 is performed on condition that the turn speed of the boom 8 is controlled to be the maximum turn speed in the current swing speed.

Specifically, the control device 40 expresses the correlation map A using the turn speed of the boom 8 and the swing speed of the upper swing body 7 with the following formula. The control device 40 converts the turn speed of the boom 8 in the following formula into the speed of the boom cylinder 11. Then, the control device 40 determines whether the converted speed of the boom cylinder 11 is larger than the preliminarily stored maximum value of the speed of the boom cylinder 11 or not.

[Math. 6]

$$\dot{\theta}_{bm}=\alpha\dot{\theta}_{sw} \tag{6}$$

In Formula (6), $\alpha$ is a coefficient representing a gradient of the correlation map A.

In a case where the converted speed of the boom cylinder 11 is larger than the maximum value of the speed, this is the case where the turn angle $\theta_{bm}$ falls below the correlation map A even when the raising operation of the boom 8 is performed on condition that the turn speed of the boom 8 is controlled to be the maximum turn speed in the current swing speed. That is, in the case where the converted speed of the boom cylinder 11 is larger than the maximum value of the speed, this is the case where the position of the front work device 2 in the height direction falls below the lower limit value of the allowable range even when the raising operation of the boom 8 is performed on condition that the turn speed of the boom 8 is controlled to be the maximum turn speed in the current swing speed. In this case, the control device 40 advances the process to Step S302. On the other hand, in a case where the converted speed of the boom cylinder 11 is equal to or less than the maximum value of the speed, this is the case where the turn angle $\theta_{bm}$ does not fall below the correlation map A when the raising operation of the boom 8 is performed on condition that the turn speed of the boom 8 is controlled to be the maximum turn speed in the current swing speed. That is, in the case where the converted speed of the boom cylinder 11 is equal to or less than the maximum value of the speed, this is the case where the position of the front work device 2 in the height direction does not fall below the lower limit value of the allowable range when the raising operation of the boom 8 is performed on condition that the turn speed of the boom 8 is controlled to be the maximum turn speed in the current swing speed. In this case, the control device 40 advances the process to Step S108.

In Step S302, the control device 40 calculates the swing speed that satisfies the relation of Formula (6) from the maximum value of the speed of the boom cylinder 11. The control device 40 automatically decelerates the swing operation of the upper swing body 7 such that the upper swing body 7 swings at the calculated swing speed. That is, the operation control section 48 of the control device 40 controls the swing speed of the upper swing body 7 such that the position of the front work device 2 in the height direction exceeds the lower limit value of the allowable range when the raising operation of the boom 8 is performed at least at the maximum turn speed.

In Step S303, the control device 40 automatically executes the raising operation of the boom 8 at the turn speed corresponding to the decelerated swing speed. Then, the control device 40 terminates the process.

In Step S106 to Step S109 shown in FIG. 11, the control device 40 executes the processes similar to Step S106 to Step S109 of Embodiment 1 shown in FIG. 7 or Embodiment 2 shown in FIG. 10.

Thus, the operation control section 48 of Embodiment 3 controls the swing speed of the upper swing body 7 such that the position of the front work device 2 in the height direction exceeds the lower limit value when the position of the front work device 2 in the height direction that moves in accordance with the operation instruction of the operator falls below the lower limit value of the allowable range and when the position of the front work device 2 in the height direction falls below the lower limit value of the allowable range even on condition that the turn speed of the boom 8 is controlled to be the maximum turn speed.

As a result, the work machine 1 of Embodiment 3 ensures keeping the position of the front work device 2 in the height direction within the allowable range even when the position of the front work device 2 in the height direction is about to fall below the lower limit value of the allowable range due to the excessive swing operation amount of the upper swing body 7 by the operator. Accordingly, the work machine 1 of Embodiment 3 ensures suppressing the interference with the loaded machine and the damage on the loaded machine, and can assist the loading work without giving uncomfortable feeling to the operator.

Embodiment 4

A description will be given of a work machine 1 of Embodiment 4 using FIG. 12. In the work machine 1 of Embodiment 4, explanations for configurations and operations similar to those of Embodiment 1 to Embodiment 3 will be omitted.

Figure 12:
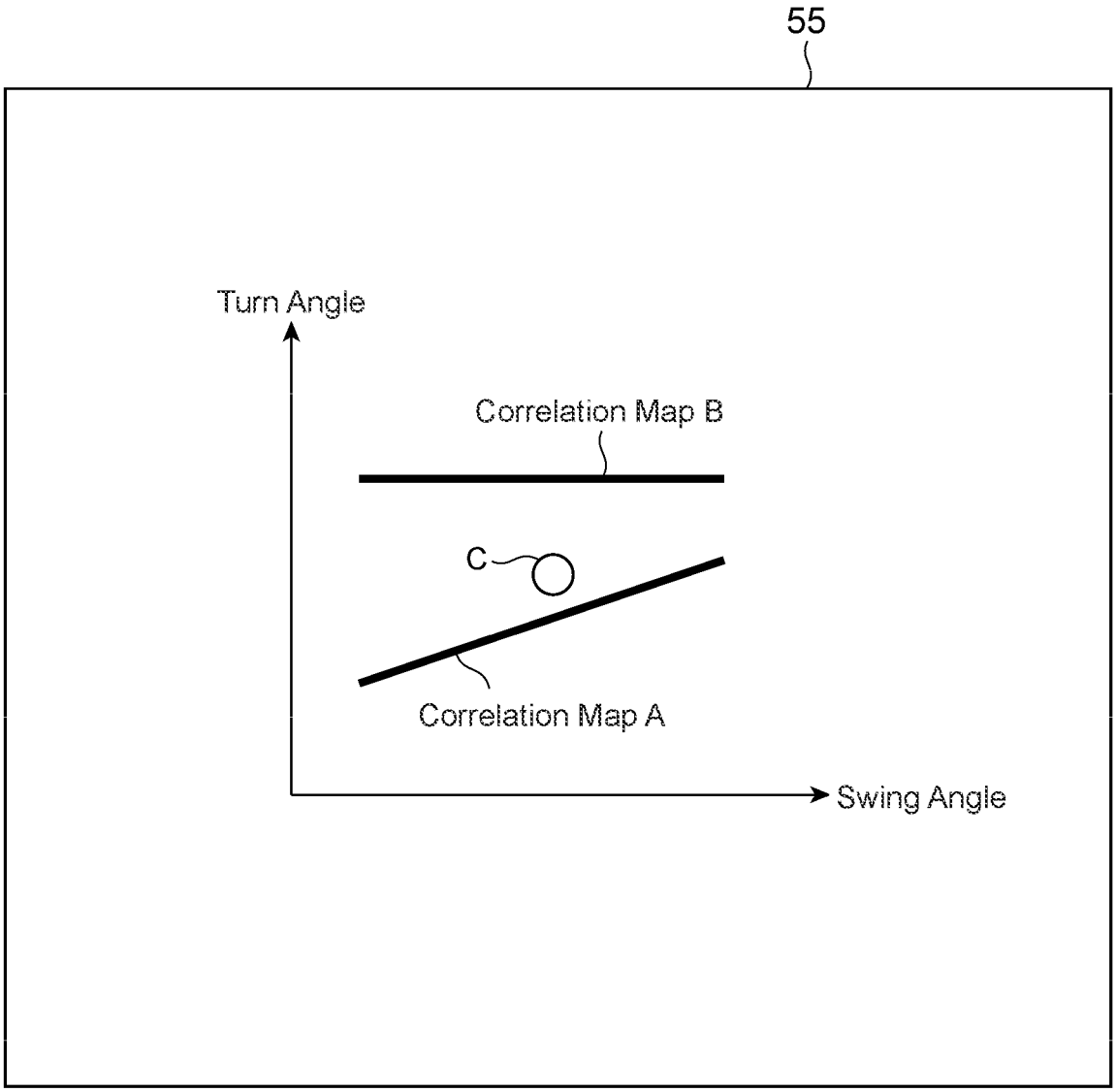
FIG. 12 is a diagram schematically illustrating a screen displayed on a display device of Embodiment 4.

FIG. 12 is a diagram schematically illustrating a screen displayed on the display device 55 of Embodiment 4.

The display device 55 of Embodiment 4 not only displays the information indicating the control intervention for assisting the loading work but also can display the correlation map A and the correlation map B as shown in FIG. 12. In this respect, the display device 55 can display an icon C superimposed on the correlation map A and the correlation map B. The icon C indicates the current position of the front work device 2 in the height direction and the swing speed of the upper swing body 7. In FIG. 12, an example in which the icon C indicating the turn angle $\theta_{bm}$ of the boom 8 and the swing angle $\theta_{sw}$ corresponding to the current position of the front work device 2 in the height direction is superimposed on the correlation map A and the correlation map B is illustrated.

As a result, the work machine 1 of Embodiment 4 not only notifies the operator of the information indicating that the control intervention for assisting the loading work is to be executed but also visualizes the specific content of the control intervention for allowing the operator to intuitively obtain it. Accordingly, the work machine 1 of Embodiment 4 allows suppressing the interference with the loaded machine and the damage on the loaded machine, and can assist the loading work without giving uncomfortable feeling to the operator, furthermore.

Others

The present invention is not limited to the above-described embodiments, and includes various modifications. For example, the above-described embodiments are described in detail for ease of understanding of the present invention, and does not necessarily include all of the described configurations. A part of the configuration of one embodiment can be replaced by the configuration of another embodiment. The configuration of another embodiment can be added to the configuration of one embodiment. Addition, deletion, or replacement of another configuration can be performed on a part of the configuration in each of the embodiments.

The above-described respective configurations, functions, processing units, processing means, or the like may be achieved by hardware, for example, a part of or all of which are designed with, for example, an integrated circuit. For example, the above-described respective configurations and functions may be achieved by software with which a processor interprets and executes programs achieving the respective functions. The program that achieves each function, tape, and information, such as files, can be placed in a memory, a storage unit, such as a hard disk and a Solid State Drive (SSD), or a storing medium, such as an IC card, an SD card, and a DVD.

Furthermore, control lines and information lines considered necessary for the description are described. Not all the control lines and the information lines on the product are necessarily described. Actually almost all configurations may be considered to be mutually coupled.

REFERENCE SIGNS LIST

1 Work machine
2 Front work device (work device)
5 Lower traveling body
7 Upper swing body
8 Boom
9 Arm
10 Bucket
40 Control device
45 Operation determining section
46 Allowable range calculation section
48 Operation control section
52 Operation detecting device
53 Posture detecting device

54 Object detecting device
55 Display device
56 Target object information acquisition device

The invention claimed is:

1. A work machine for loading a target object onto a loaded machine by performing a convey operation and a dump operation, the convey operation conveying the target object toward the loaded machine, the dump operation dumping the target object conveyed by the convey operation onto the loaded machine, the work machine comprising:

an upper swing body that swings with respect to a lower traveling body;

a working device mounted on the upper swing body and including a boom, an arm, and a bucket;

a posture detecting device that detects a turn angle of the working device and a swing angle of the upper swing body;

an object detecting device that detects a position of the loaded machine; and a control device that controls operations of the working device and the upper swing body, wherein the control device includes:

an allowable range calculation section that calculates an allowable range indicating a range in which the working device is movable in a height direction allowed in the swing operation of the upper swing body based on a detection result of the object detecting device;

an operation determining section that determines whether the work machine is under the convey operation or not based on a detection result of the posture detecting device and a detection result of the object detecting device;

an operation control section that controls a turn operation of the boom such that the position of the working device in the height direction remains within the allowable range when the work machine is determined to be under the convey operation, wherein the allowable range calculation section calculates a range of the turn angle of the boom defined by a lower limit value and an upper limit value as the allowable range, the lower limit value of the position in the height direction allowing the working device to avoid interference with the loaded machine under the convey operation, the upper limit value of the position in the height direction obtained based on at least one of a dimension of the bucket, a capacity of the bucket, a type of the target object, or a specific gravity of the target object.

2. The work machine according to claim 1, further comprising an operation detecting device that detects an operation instruction by an operator to the working device, wherein the operation control section invalidates the operation instruction when the position of the working device in the height direction that moves in accordance with the operation instruction falls below the lower limit value or exceeds the upper limit value, and controls the turn speed of the boom such that the position of the working device in the height direction remains within the allowable range.

3. The work machine according to claim 2, wherein the operation control section controls a swing speed of the upper swing body such that the position of the working device in the height direction exceeds the lower limit value when the position of the working device in the height direction that moves in accordance with the operation instruction falls below the lower limit value and the position of the working device in the height direction falls below the lower limit value even when the operation control section controls the turn speed of the boom to a maximum turn speed.

4. The work machine according to claim 2, wherein the allowable range calculation section updates the allowable range using the position of the working device in the height direction when the operation instruction becomes undetectable newly as the lower limit value in a case where the operation instruction becomes undetectable while the working device moves in accordance with the operation instruction within the allowable range.

5. The work machine according to claim 1, further comprising a target object information acquisition device that obtains information on the target object held in the bucket, wherein the operation determining section determines whether the bucket holds the target object based on a result obtained by the target object information acquisition device and determines whether the work machine is under the convey operation based on the determination result.

6. The work machine according to claim 1, further comprising a display device that displays a correlation map indicating a relation between the swing angle of the upper swing body and the lower limit value and a relation between the swing angle of the upper swing body and the upper limit value, wherein the display device displays an icon indicating a current position of the working device in the height direction and a current swing angle of the upper swing body with the correlation map superimposed.

* * * * *